US006622321B1

(12) United States Patent
Leib

(10) Patent No.: US 6,622,321 B1
(45) Date of Patent: Sep. 23, 2003

(54) CONVERTIBLE BED WITH A SECTIONAL ARTICULATED BACK

(75) Inventor: Roger K. Leib, Los Angeles, CA (US)

(73) Assignee: KI-ADD Specialized Support Technology, Inc., Green Bay, WI (US)

( * ) Notice: Subject to any disclaimer, the term of this patent is extended or adjusted under 35 U.S.C. 154(b) by 0 days.

(21) Appl. No.: 10/118,269

(22) Filed: Apr. 8, 2002

Related U.S. Application Data

(63) Continuation-in-part of application No. 09/378,582, filed on Aug. 20, 1999, now Pat. No. 6,347,418.
(60) Provisional application No. 60/295,127, filed on Jun. 1, 2001.

(51) Int. Cl.[7] ..... A47C 17/16
(52) U.S. Cl. ..... 5/45; 5/43
(58) Field of Search ..... 5/45, 43, 46.1

(56) References Cited

U.S. PATENT DOCUMENTS 6,347,418 B1 2/2002 Leib ..... 5/45

*Primary Examiner*—Alexander Grosz
(74) *Attorney, Agent, or Firm*—Boyle Fredrickson, Newholm, Stein & Gratz, S.C.

(57) ABSTRACT

A convertible article of furniture includes a primary cushion member supported by a support structure, and a backrest assembly which is movable relative to the primary cushion member between an upstanding rearward position and a lowered forward position. The backrest assembly has a sectional articulated construction, including an inner backrest member and an outer backrest member. When the backrest assembly is in the upstanding rearward position, the outer backrest member extends upwardly from the inner backrest member to support the upper back area of a user seated upon the primary cushion member. When the backrest assembly is moved to its lowered forward position, the outer backrest member is moved downwardly and inwardly relatively to the inner backrest member, to an unobtrusive stored position. A linkage or arm arrangement is interposed between the support structure of the convertible bed and the inner and outer backrest members, for providing movement of the backrest assembly relative to the primary cushion between the upstanding rearward position and the lowered forward position.

25 Claims, 16 Drawing Sheets

CONVERTIBLE BED WITH A SECTIONAL ARTICULATED BACK

CROSS REFERENCE TO RELATED APPLICATION

This application claims the benefit of U.S. Provisional Application Ser. No. 60/295,127, filed Jun. 1, 2001. This application is also a continuation-in-part of application Ser. No. 09/378,582, filed Aug. 20, 1999 now U.S. Pat. No. 6,347,418.

FIELD OF THE INVENTION

The present invention relates to beds, and more specifically, to a bed that is convertible between a sleeping configuration and a seating configuration.

BACKGROUND OF THE INVENTION

In many residential and institutional settings, it is common to utilize furniture which is capable of performing more than one function due to a limited amount of available living space. For example, in order to conserve space, a bed may also double as sitting furniture such as a couch. In this manner, the need for additional furniture is eliminated such that available space is utilized efficiently while providing all functions required for occupants of the space. A number of dual-purpose articles of furniture have been developed for use in limited space environments. One example is a conventional futon frame which can be positioned in either a seating configuration or a sleeping configuration. The frame supports a cushion which provides a comfortable sleeping or seating surface. In order to move the frame between its sleeping and seating configurations, it is necessary for the user to manually manipulate and reposition the entirety of the frame and the cushion.

Pull-out bed systems are also known, and include a mattress and frame combination adapted for movement to an outward sleeping position relative to a cabinet wall, in which the entire upper surface of the mattress is exposed. In one form, the mattress and frame are moved inwardly to a sitting position such that an inner portion of the mattress and frame are located below a cabinet and an outer portion defines a sitting surface located outwardly of the cabinet. The cabinet doors are typically padded, and form a backrest when the mattress and frame are in the inward sitting position. In another form, the mattress and frame can be slid or pivoted such that the entirety of the bed is stored away when not in use. These systems require the user to move the entirety of the mattress and frame between its inward and outward positions.

It is an object of the present invention to provide a dual purpose article of furniture which can be utilized in either a sleeping configuration or a sitting configuration. It is a further object of the invention to provide such an article of furniture which is well suited for use in a built-in environment. Yet another object of the invention is to provide such an article of furniture in which a minimum amount of effort is required to provide either a sleeping or sitting configuration for the article of furniture. Yet another object of the invention is to provide such an article of furniture which is easily installed in a predetermined amount of space and which is readily suited for retrofit installations. A still further object of the invention is to provide such an article of furniture which is relatively simple in its components and construction, yet which provides highly satisfactory operation as both sitting and sleeping furniture.

SUMMARY OF THE INVENTION

The present invention is a convertible daybed that includes a support, a cushion assembly connected to the support, and a backrest assembly connected to a swing arm assembly that is attached to the support on either side of the cushion assembly. The swing arm assembly is capable of easily and quickly moving the backrest assembly between a seating configuration and a sleeping configuration. The shape of the backrest that forms a part of the backrest assembly allows the backrest assembly to be positioned in either a conventional seating configuration or a substantially flat sleeping configuration with the cushion assembly.

The support may form a top wall of a hollow pedestal that can be used to store items such as sheets and pillows that are used in conjunction with the daybed. The daybed may also include a retractable sheet disposed beneath a rear area of the cushion assembly or elsewhere within the assembly to selectively provide a cover sheet for the daybed when in the sleeping configuration.

The construction of the daybed is simple and easy to assemble and maintain, allowing the daybed to be used in a wide variety of residential and institutional settings.

The swing arm assembly includes a bracket or other pivotable mounting arrangement attached to the support adjacent either end of the cushion assembly and a swing arm pivotably attached between the bracket and the backrest assembly. The swing arm assembly allows the backrest assembly to be moved from a seating configuration in which the backrest assembly is positioned vertically at the back of the cushion assembly to form a backrest, to a sleeping configuration in which the backrest assembly forms a level extension forwardly of the cushion assembly.

The backrest assembly includes a backrest shaped such that the bottom surface of a backrest pad in the assembly can conform to the shape of both the front and rear faces of each cushion forming the cushion assembly. Furthermore, when the backrest assembly is positioned in the sleeping configuration, the rear surface of the backrest lies coplanar with a top face of the cushions providing a substantially flat sleeping surface for the daybed.

The support on which the cushion and swing arm assemblies are mounted may form the top surface of a pedestal that positions the daybed above the floor of a room. The pedestal may have a hollow interior allowing items to be stored inside the pedestal beneath the daybed. To allow access to the interior of the pedestal, the support may be removable from the pedestal by lifting the support off of the pedestal using a handle secured to a front edge of the support. In another form, the pedestal may have an open front, and items may be accessible through doors mounted to the pedestal or within drawers for movement into and out of the interior of the pedestal.

The rearward extensions are removably insertable under retainers affixed to the support and open to receive the extensions. Each cushion frame includes a number of screws integrally attached to the bottom of the frame opposite the extensions that are removably insertable under aligned retainers on the support. The screws are removably fastened to the support by nuts threadably engaged with the ends of each screw protruding through the openings.

To enhance the convenience of the convertible bed when placed in the sleeping configuration, the bed may also include a retractable cover membrane or sheet mechanism located in a channel defined beneath the rear face of the cushion assembly. The cover membrane or sheet mechanism includes a fabric membrane that is connected to a spring retractor mechanism. The membrane or sheet is fastened to the backrest to extend over the bed in the sleeping configuration, and is automatically retracted when the backrest is replaced in the seating configuration.

The above summary pertains to a convertible bed with a single backrest cushion. In another form, the backrest may have a sectional construction to increase the overall height of the backrest. The sectional backrest construction includes an inner back section or cushion and an outer back section or cushion. The inner back cushion is preferably interconnected with the support as previously described, for movement between an upstanding rearward position to provide the seating configuration, and a lowered forward position to provide the sleeping configuration. When the backrest is in the upstanding rearward position, the inner section of the backrest extends upwardly from the seat cushion as described above. When the backrest is in the lowered forward position, the inner section of the backrest extends forwardly from the forward edge of the seat cushion to define an extension of the seat cushion.

The outer section of the sectional backrest extends upwardly from the inner section when the backrest is in its upstanding rearward position, to provide support for the upper area of a user's back when seated on the seat cushion. The outer section is moved to an inoperative position when the backrest is moved to its lowered forward position. In the inoperative position, the outer section of the backrest is positioned below and inwardly of the inner section. The outer backrest section does not form a part of the sleeping surface when the backrest is moved to its lowered forward position, but rather is moved to an unobtrusive location below the inner section of the backrest. The outer backrest section is moved between its operative and inoperative positions via a linkage or arm arrangement which is interconnected with the pivot arm to which the inner backrest section is mounted. The arm or linkage arrangement functions to automatically move the outer backrest section between its operative and inoperative positions in response to movement of the inner backrest section between its upstanding rearward position and its lowered forward position.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

The present invention relates to a daybed construction that functions as either a seat or a bed.

Figure 1:
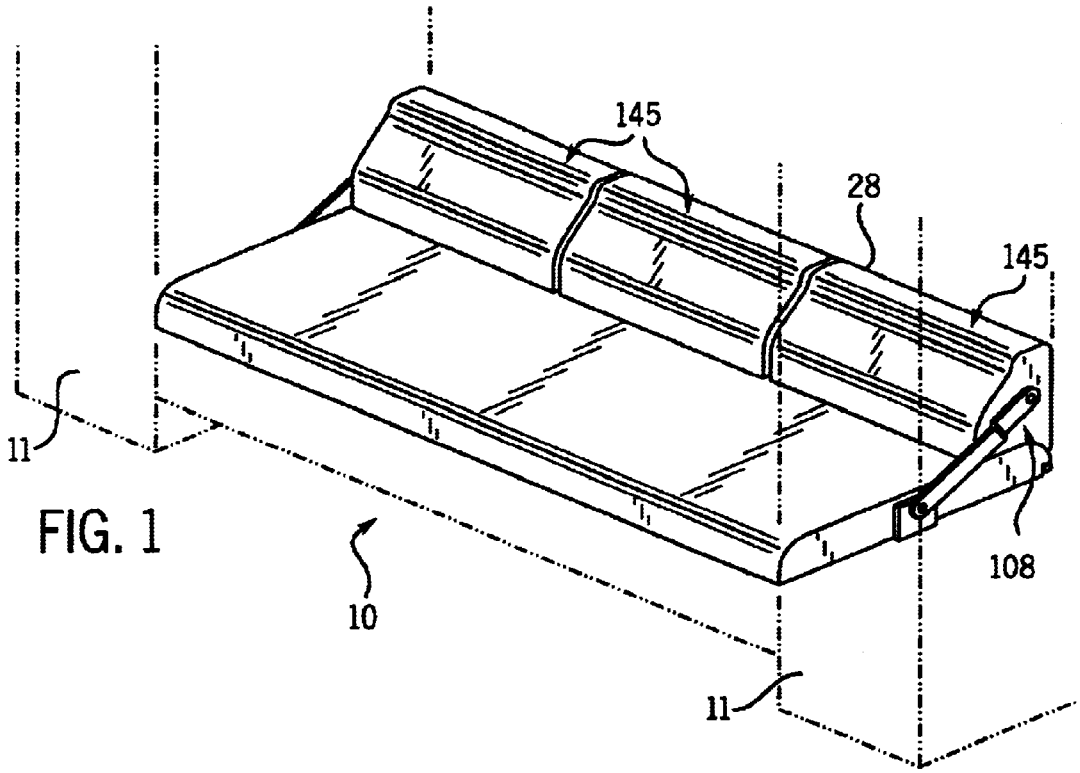
FIG. 1 is an isometric view of a fixed-position version of a convertible daybed with a pivotable backrest constructed according to the present invention, shown in a seating configuration.

Referring to FIG. 1, a convertible daybed 10 is shown in a seating configuration, disposed between a set of cabinets 11 and abutting a rear wall 28. In a manner to be explained, daybed 10 may be converted from the seating configuration shown in FIG. 1 to a sleeping configuration shown in FIG. 2 by shifting a backrest assembly 108 from a seating configuration to a sleeping configuration.

Figure 3:
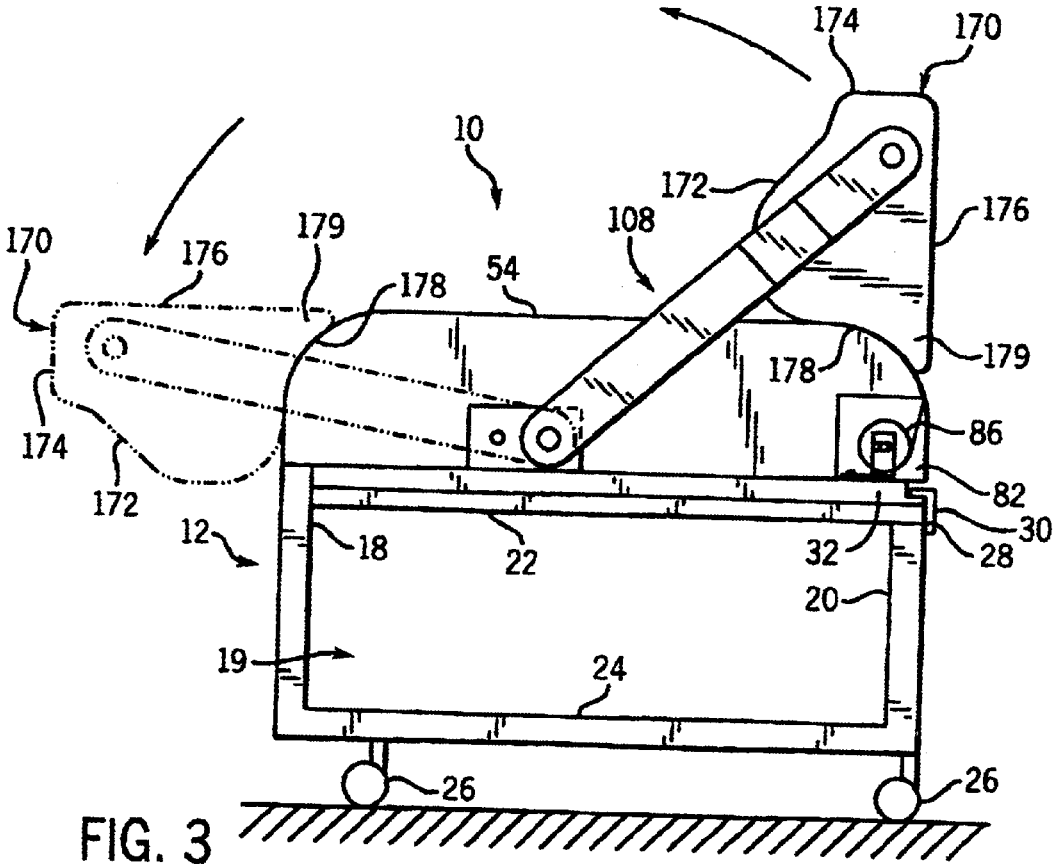
FIG. 3 is an end elevation view of a movable version of a daybed similar to that shown in FIGS. 1 and 2.
Figure 4:
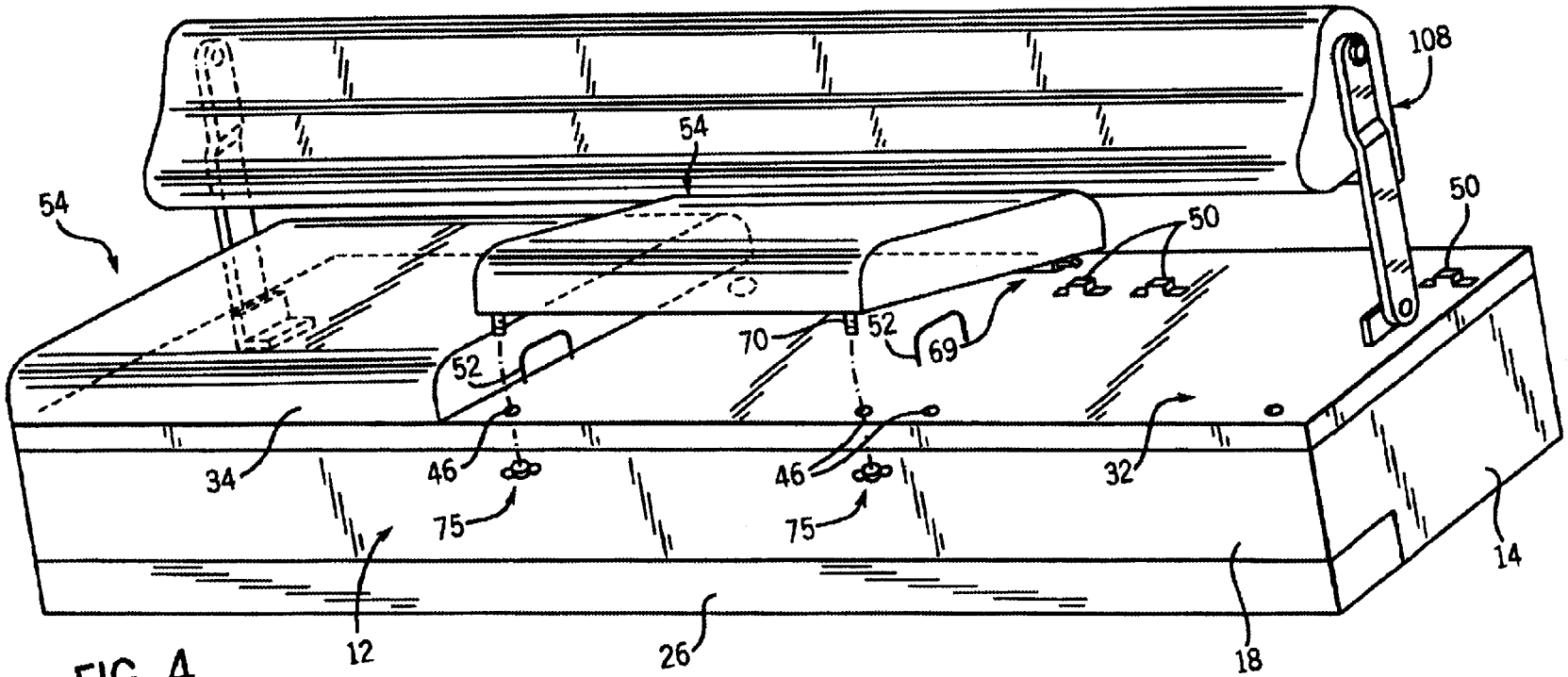
FIG. 4 is an isometric view of the daybed of FIG. 1 showing the support and removability of the cushions.

As shown in FIGS. 3 and 4, daybed 10 is supported by a pedestal 12 which is generally rectangular in shape and supports daybed 10 above a floor surface. Pedestal 12 includes a front panel 18, a rear panel 20 that may abut a rear wall 28 behind daybed 10, a pair of side members 22 extending along the sides of pedestal 12 from the top of rear panel 20 to the side of front panel 18, and a bottom panel 24 extending between front panel 18 and rear panel 20. As side members 22 extend along each of the sides of pedestal 12 perpendicular to front panel 18 and rear panel 20, pedestal 12 defines a storage area 19 which may be utilized to store accessories used with daybed 10 or for storing other articles as desired. The pedestal 12 may be supported by a series of casters 26 (FIG. 3), or may be in the form of a frame supported by a series of legs with depending arms for storage. The sides of pedestal 12 are formed from a pair of side panels 14 attached over the open sides of pedestal 12 and legs 26.

Figure 5:
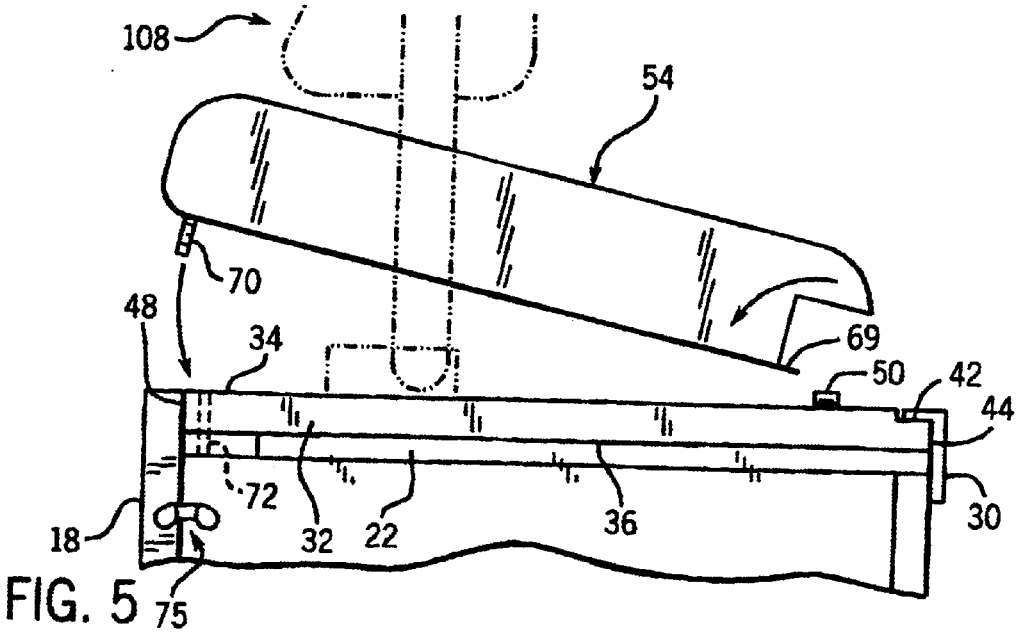
FIG. 5 is a partial end elevation view of the daybed as illustrated in FIG. 4.
Figure 6:
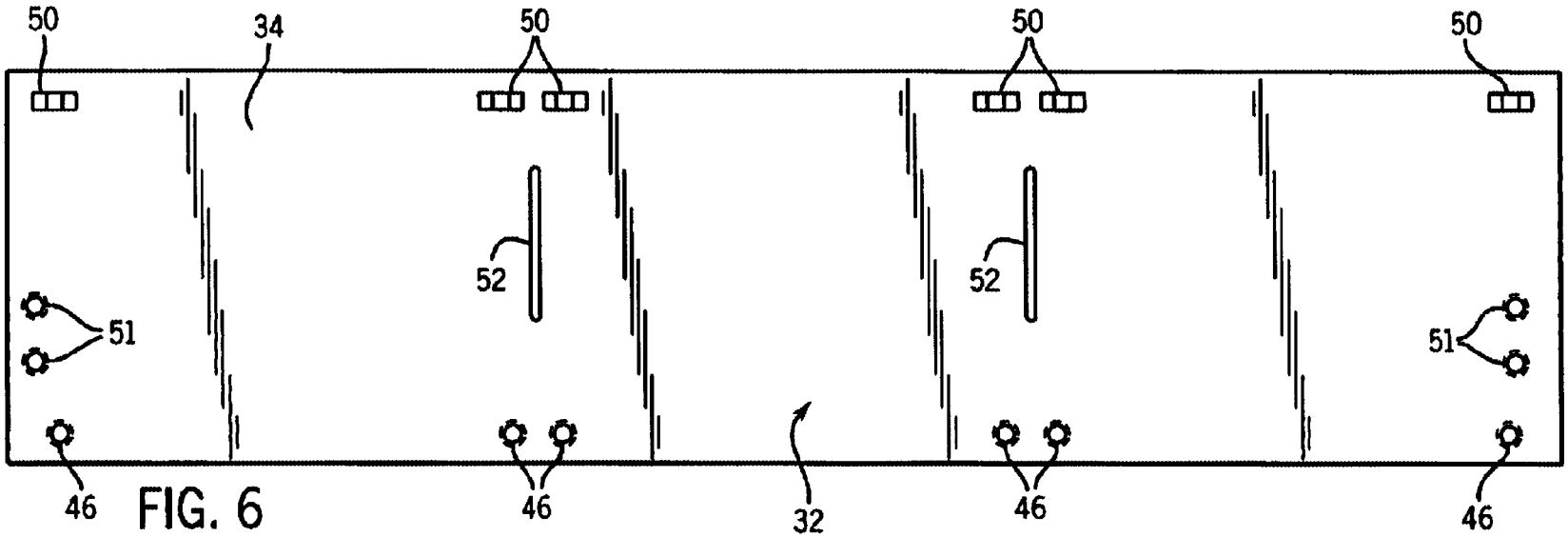
FIG. 6 is a top plan view of the support forming a part of the daybed of FIG. 1.
Figure 6A:
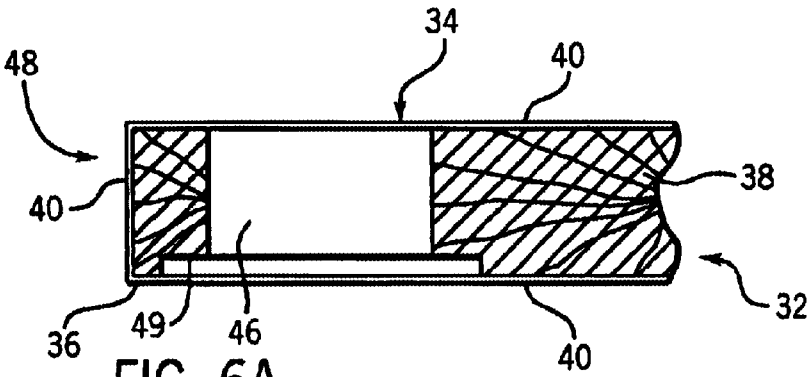
FIG. 6A is a partial cross-sectional view of a cushion mounting aperture in the support of FIG. 6.

Referring to FIGS. 4–6, a hollow steel frame version of daybed 10 is illustrated as including a deck 32 placed over the top of pedestal 12 to enclose pedestal 12 and for mounting a cushion assembly thereto. Deck 32 includes a top surface 34, a bottom surface 36, a rear surface 44 and a front surface 48. As shown in FIG. 6A, deck 32 is formed of an inner core material 38 laminated with a backer board layer 40 over each surface of deck 32. Deck 32 further includes a number of cushion mounting apertures 46, each of which includes a lip 49 disposed adjacent the front surface 48 of deck 32. A series of retainer brackets 50 are mounted to deck 32 adjacent the rear surface of desk 32. A pair of mounting bracket openings 51 are disposed adjacent each side of deck 32, and are located toward front surface 48. Deck 32 is positioned and held against pedestal 12 by a retaining angle 30 attached to rear panel 20 of pedestal 12, that engages a step 42 located in rear surface 44 of deck 32. Also, referring to FIG. 3, as front panel 18 of pedestal 12 extends above side rails 22 and rear panel 20, the top portion of front panel 18 retains deck 32 over pedestal 12. Deck 32 may be removed from pedestal 12 to allow access to cushion frame retainer screws through the use of a pair of handles 52 secured to deck 32 between adjacent cushions of a cushion assembly, that allow a user to pull deck 32 up over the top edge of front panel 18 of pedestal 12 and slide deck 32 off of pedestal 12, moving step 42 out of engagement with retaining strip 30 and allowing deck 32 to be removed from pedestal 12. Deck 32 is mounted over pedestal 12 by reversing this series of steps.

Figure 9:
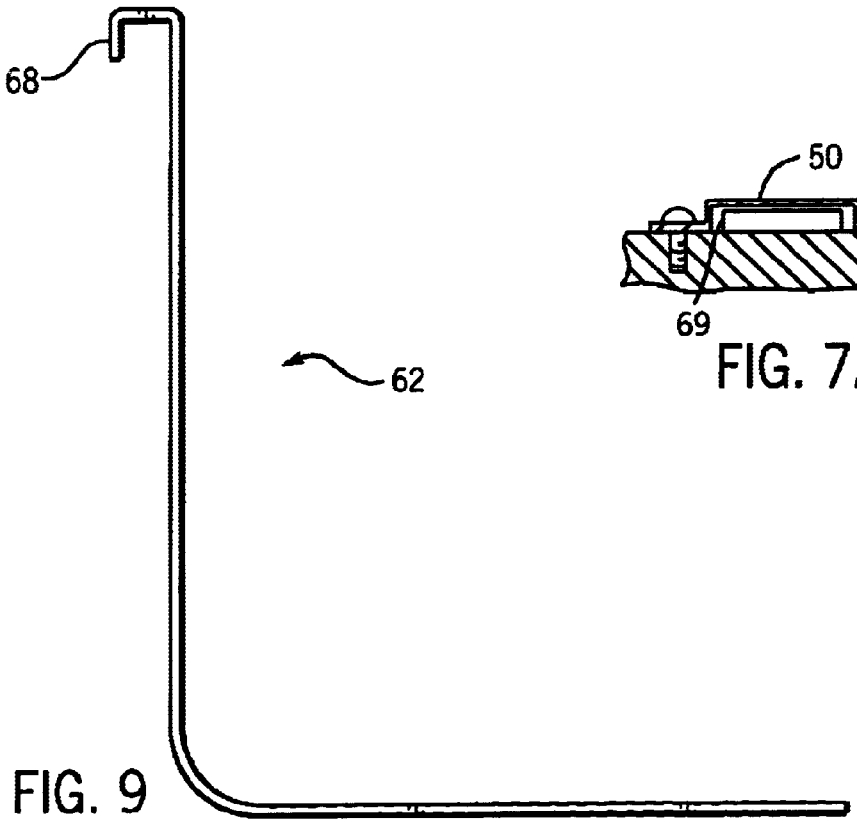
FIG. 9 is an end elevation view of a cover bracket forming a part of the frame of FIG. 7.
Figure 7A:
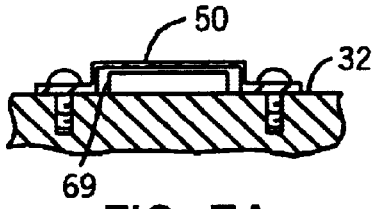
FIG. 7A is a partial section view illustrating retainer arrangement for engaging the cushions with the support member.

FIGS. 4–5 and 7–9 illustrate the construction of the cushion assembly adapted to be attached to deck 32. The cushion assembly is made up of a number of seat cushions 54 that each include a mounting frame 56 that supports a foam pad 74. Each frame 56 includes a front bracket 58, a pair of side brackets 60, and a rear cover bracket 62. Front bracket 58 is a flat metallic piece having a pair of mounting bores 72 located adjacent each end. Each of side brackets 60 is formed of a metallic strip including a raised portion 64 located adjacent one end, and an elevated end 66 opposite raised portion 64 that forms a right angle in side brackets 60. As shown in FIG. 9, rear cover bracket 62 is a generally L-shaped metallic strip that is complementary to elevated end 66 of side brackets 60. Also, rear cover bracket 62 includes a U-shaped locking channel 68 at one end that includes a rounded edge adapted to receive and engage the end of elevated end 66 of side brackets 60 to hold rear cover bracket 62 in engagement with side brackets 60. The rounded edge of locking channel 68 enables a fabric over-cover, which will later be explained, to easily slide past rear cover bracket 62. Front bracket 58, side brackets 60 and rear cover bracket 62 are preferably welded together to form frame 56.

Figure 7:
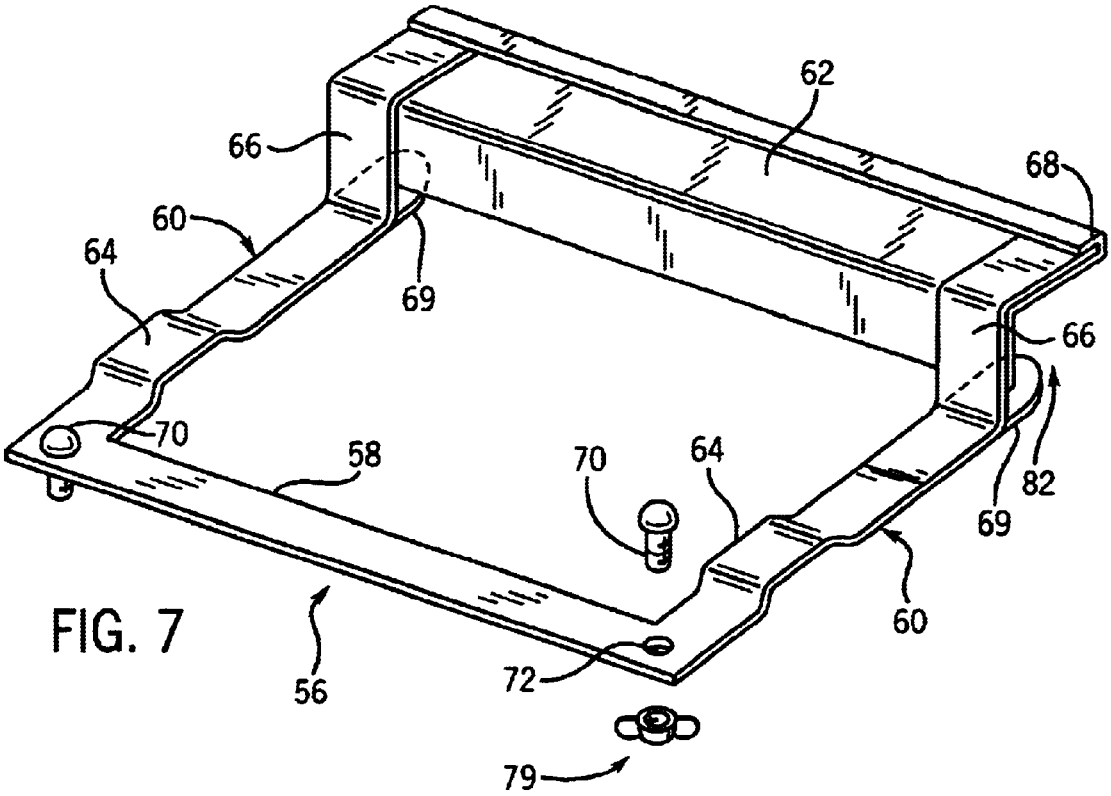
FIG. 7 is an isometric view of a frame of a cushion of the daybed of FIG. 1.

Frame 56 also includes a pair of threaded screws 70 inserted through mounting bores 72 and secured by wing nuts 75, and a pair of mounting tabs 69 used to secure the frame 56 to the platform 32 by engagement with retainers 50. With side brackets 60 constructed as shown in FIG. 7, each mounting tab 69 is located slightly forwardly of elevated end 66.

Each mounting tab 69 is inserted into a space defined by retainer 50 so that tab 69 underlies retainer 50 to prevent the cushion 54 from being lifted off of deck 32. The front end of the cushion 54 is then lowered so that the pair of threaded screws 70 which extend through screw bores 72 in the corners of front bracket 58, are inserted through front apertures 46 in deck 32. The cushion 54 is removably secured on deck 32 through the engagement of circular foot 73 with the lip 49 of rear aperture 50 and by wing nuts 75 threadedly mounted onto threaded screws 70 and engaged with the bottom surface 36 of deck 32.

It should be understood that the seat cushion assembly shown and described is but one satisfactory way to secure the seat cushions 54 to deck 32, and that other removable mounting systems could be employed.

Figure 8A:
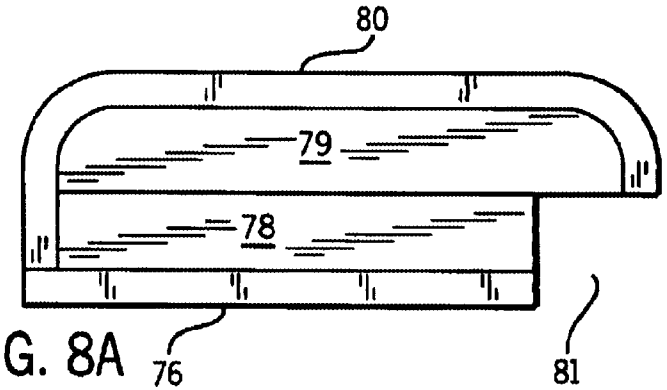
FIG. 8A is a side elevation view of the cushion of FIG. 8.
Figure 8C:
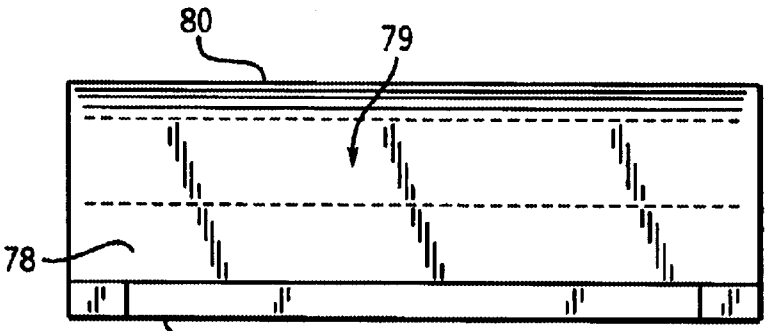
FIG. 8C is a front elevation view of the cushion of FIG. 8.
Figure 8:
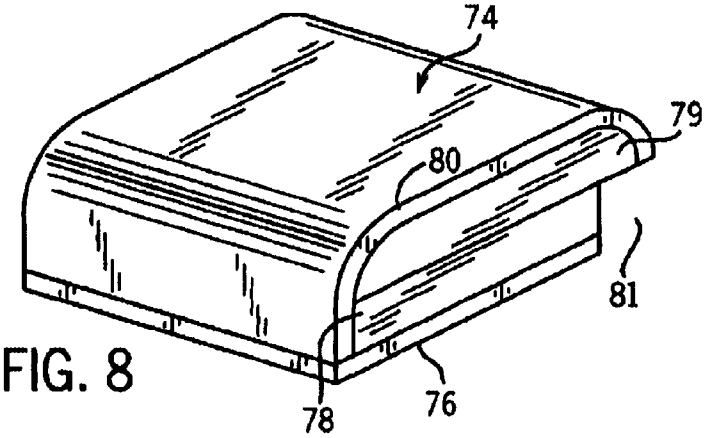
FIG. 8 is an isometric view of a cushion of the daybed of FIG. 1.
Figure 8B:
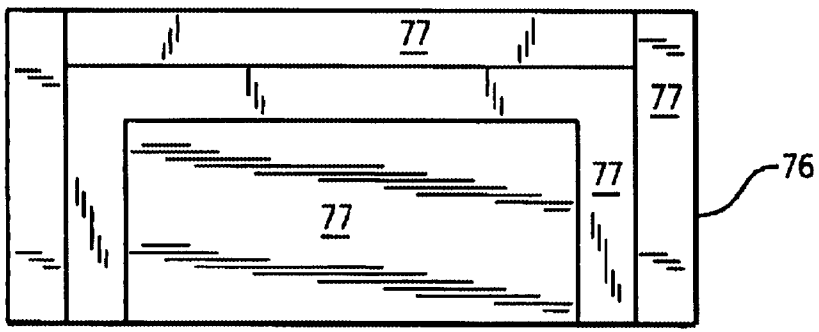
FIG. 8B is a bottom plan view of the base of the cushion of FIG. 8.

The foam pad 74 of cushion 54 is shown in FIGS. 8–8C. The foam pad 74 consists of a base layer 76 formed of a resilient material supporting a lower foam cushion layer 78 and an upper foam cushion layer 79. The foam cushion layers 78 and 79 are covered by a cover 80 that forms the top of the foam pad 74. Velcro strips (not shown) are affixed along the inside edges of frame 56 and are adapted to mate with complementary Velcro strips (not shown) located on securing flaps (not shown) on cover 80 to secure cover 80 to the underside of frame 56. As seen in FIG. 8B, base layer 76 is comprised of foam strips 77 that are made of a very firm flexible foam. Base layer 76 and lower foam cushion layer 78 have a length less than upper foam cushion layer 79 and cover 80 to form a cut out 81. Cut out 81 allows foam pad 74 of cushion 54 to form a square channel 82 above the pedestal 12 and to enclose the arrangement of the rear cover bracket 62 and elevated ends 66 of side brackets 60 along the rear of the cushions 54 when frame 56 and foam pad 74 are assembled and attached to deck 32 in the manner of FIG. 3.

Figure 2:
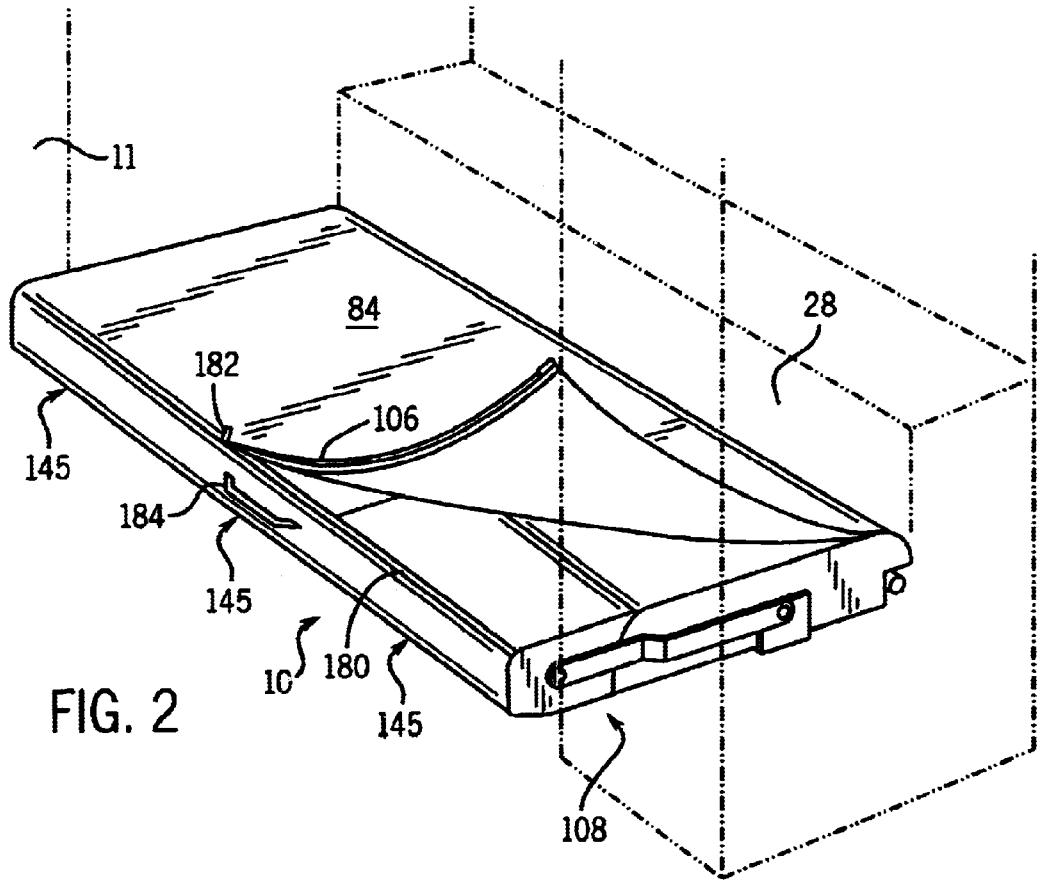
FIG. 2 is an isometric view of the daybed of FIG. 1 shown in the sleeping configuration.
Figure 10:
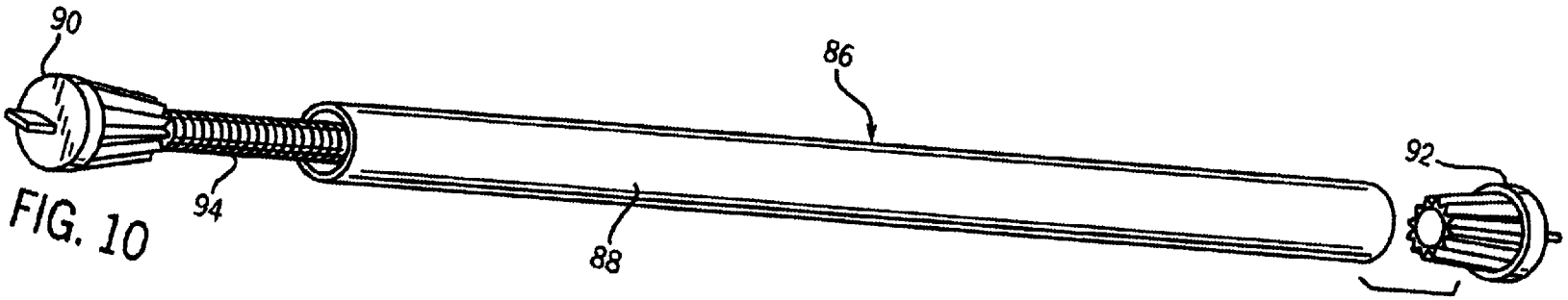
FIG. 10 is a partially exploded isometric view of a retractor mechanism incorporated into the daybed of FIG. 1.
Figure 11:
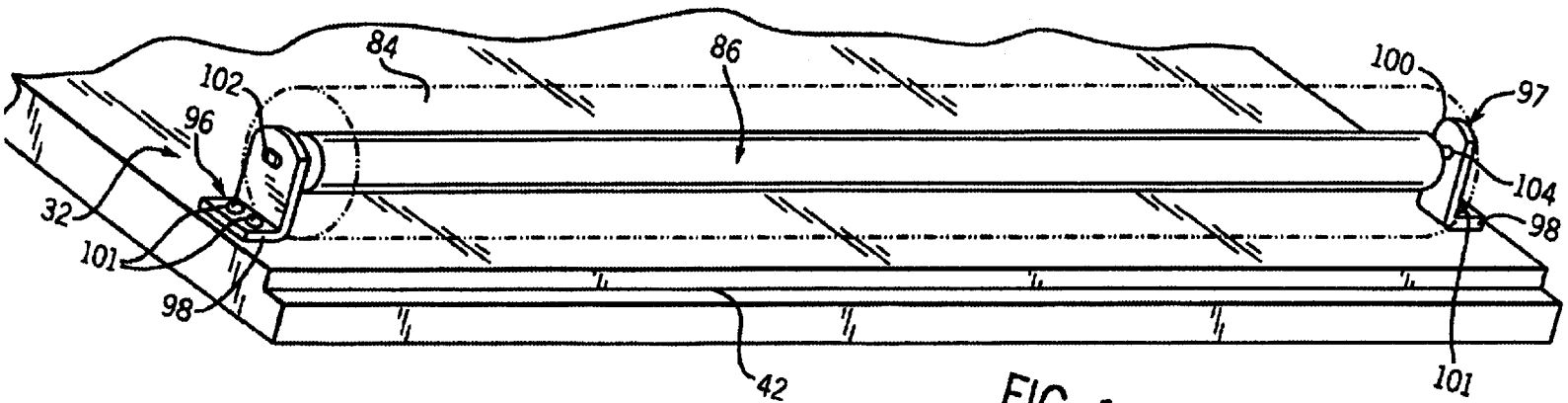
FIG. 11 is an isometric view of the retractor mechanism of FIG. 10 attached to the support of the daybed of FIG. 1.

The square channel 82 encloses a retractor mechanism 86 to which a bed cover 84 is connected for use when the daybed 10 is in the sleeping configuration shown in FIG. 2. As shown in FIGS. 10–11, the retractor mechanism 86 includes a tube 88 that encloses a rewind spring 94. The rewind spring 94 is held within the tube 88 by a tab adaptor 90 engaged within one end of tube 88, and a pin adaptor 92 is pressed into the opposite end of tube 88. The retractor mechanism 86 is connected to deck 32 adjacent step 42 on the rear surface 44 of deck 32 by a pair of brackets 96 and 97 attached to deck 32. Brackets 96 and 97 each have a flat mounting portion 98 including screw openings into which are threaded screws 101 to secure the brackets 96 and 97 to deck 32. Each bracket 96 and 97 also has an upwardly extending retractor mounting portion 100 that is used to engage and hold retractor mechanism 86 between brackets 96 and 97. Each bracket 96 and 97 may alternatively include a mounting flange (not shown) extending from bracket 96 or 97 opposite mounting portion 100, to secure bracket 96 or 97 to a side of deck 32. Bracket 96 has a pin opening 104 near the top of retractor mounting portion 100 adapted to receive the pin adaptor 92 of retractor mechanism 86. Similarly, bracket 97 has a tab slot 102 adapted to receive the tab adaptor 90 of retractor mechanism 86. Retainer mechanism 86 and tube 88 may also enclose rewind spring 94 and be secured to deck 32 by a pair of tab adaptors 90 engaged in either end of tube 88. In such an arrangement, tube 88 is secured to deck 32 by a pair of brackets 97 including tab slots 102 that receive tab adaptors 90 extending from either end of tube 88.

Figure 12A:
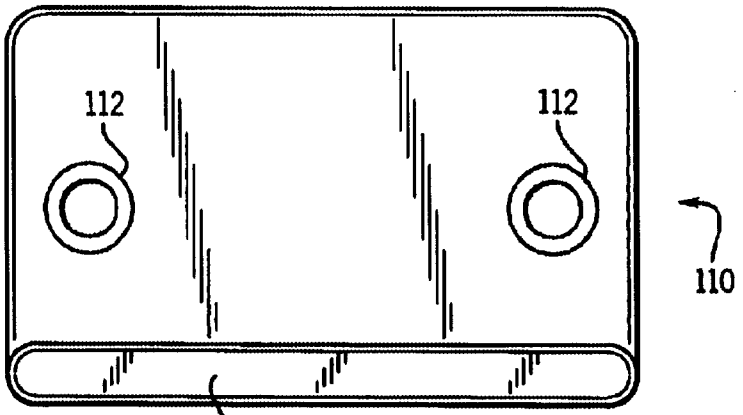
FIG. 12A is a top plan view of one of the mounting brackets of FIG. 12.
Figure 12B:
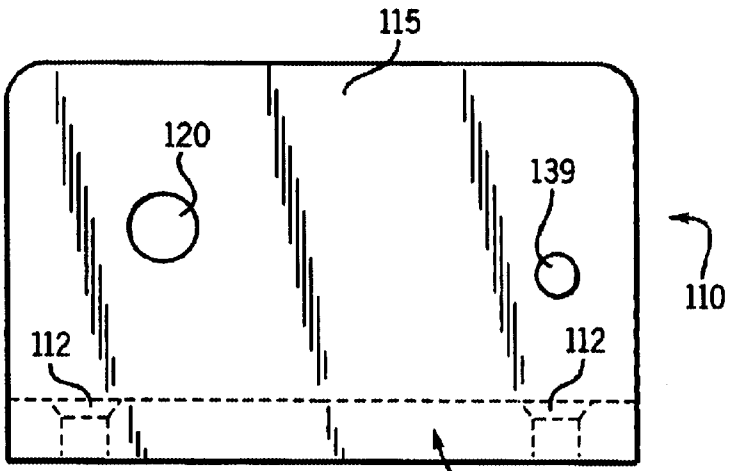
FIG. 12B is a front elevation view of one of the mounting brackets of FIG. 12.
Figure 12:
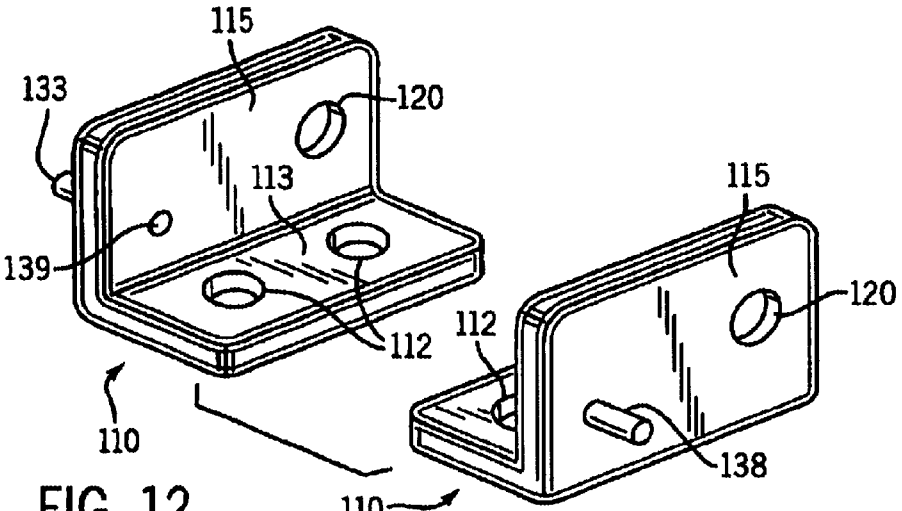
FIG. 12 is an isometric view of a pair of facing mounting brackets for the swing arm assembly of the daybed of FIG. 1.

Referring now to FIGS. 12–15C, daybed 10 is shown as including a pivotable backrest assembly 108 which is attached to deck 32 by a pair of L-shaped facing brackets 110 secured on deck 32 on either side of the cushions 54. Each bracket 110 includes a pair of bracket mounting openings 112 located on the lower portion 113 of bracket 110 as shown in FIGS. 12–12B. A pair of screws 114 are inserted through bracket mounting openings 112 into openings 51 in deck 32, each of which receives a coupling member 116 having a passage through which the shank of one of screws 114 extends. A lock nut 118 is threadably engaged with each screw 114 to thereby securely mount each bracket 110 to deck 32. In this position, lower portion 113 of bracket 110 is positioned beneath raised portion 64 of side bracket 60 of frame 56 when the cushions 54 are attached to deck 32.

Each bracket 110 also includes an upper portion 115 provided with a swing arm opening 120. A swing arm 122, which includes an upper arm portion 124 and a lower arm portion 126 joined by an angled bend 128, is secured at its lower end by an internally threaded stud 132 inserted through a mounting opening 130 in lower arm portion 126 and tack welded thereto to prevent rotation of stud 132 relative to arm 122. Low-friction washers 134 are disposed on either side of opening 120 in bracket 110 when stud 132 is inserted through swing arm opening 120. Swing arm 122 is pivotably secured to bracket 110 by a screw 136 threadably engaged within the threaded internal passage defined by stud 132.

A stop pin 138 is located on upper portion 115 of each bracket 110, extending outwardly from a stop pin opening 139 in upper portion 115 of bracket 110. Stop pin 138 is operable to limit the pivoting movement of swing arm 122, in a manner to be explained.

Figure 14:
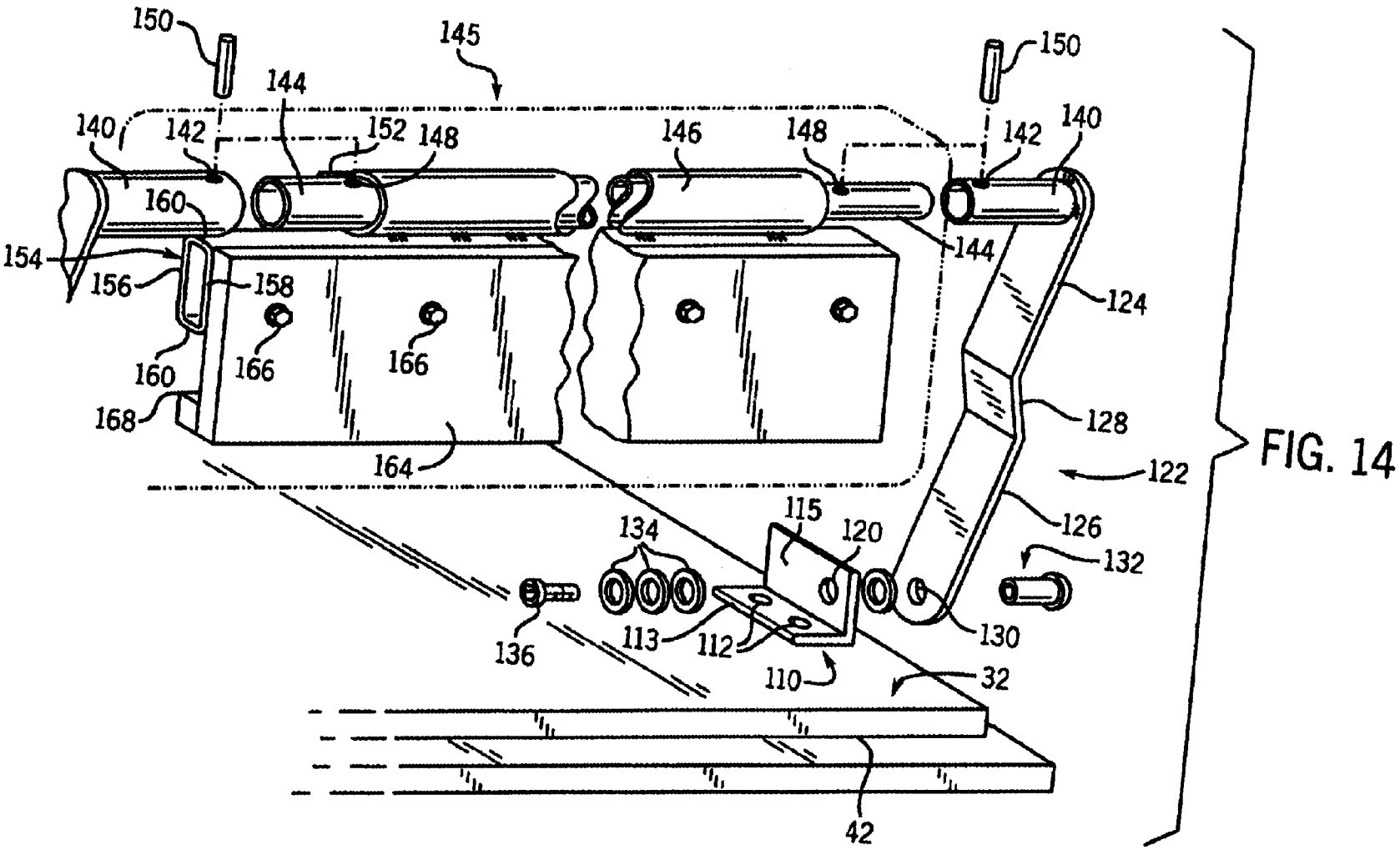
FIG. 14 is a partial exploded isometric view of the backrest assembly and the swing arm assembly of the daybed of FIG. 1.
Figure 15A:
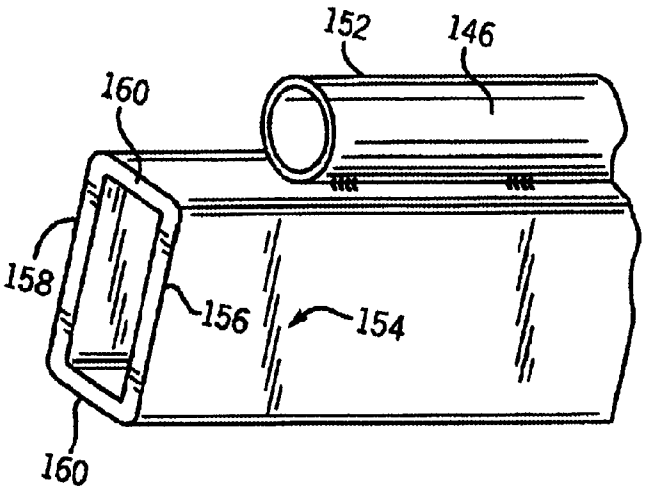
FIG. 15A is a partial isometric view of an end portion of the backrest interior structure of FIG. 15.
Figure 15:
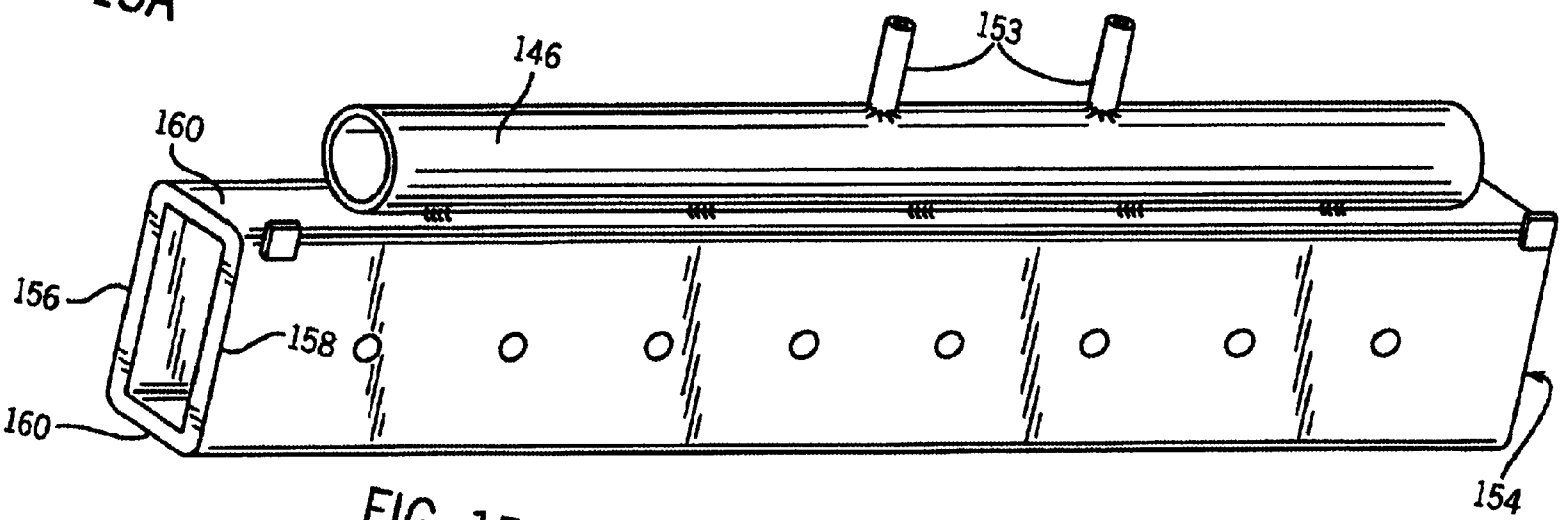
FIG. 15 is an isometric view of a portion of the interior structure incorporated into the backrest assembly of FIGS. 13 and 14.
Figure 15B:
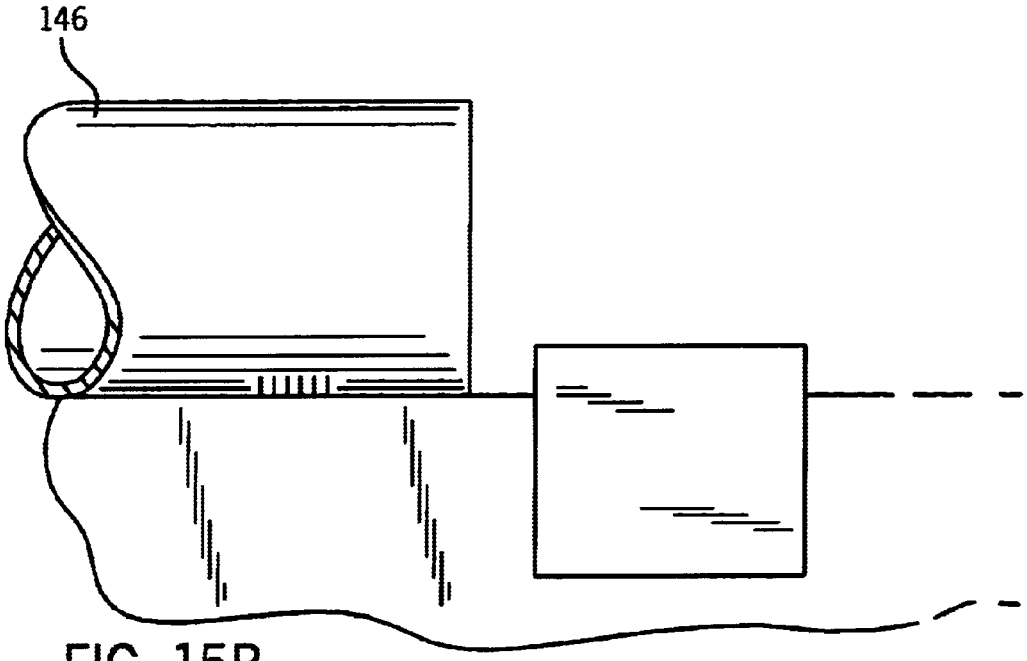
FIG. 15B is an enlarged partial rear elevation view of the end portion of the backrest interior structure of FIG. 15.
Figure 15C:
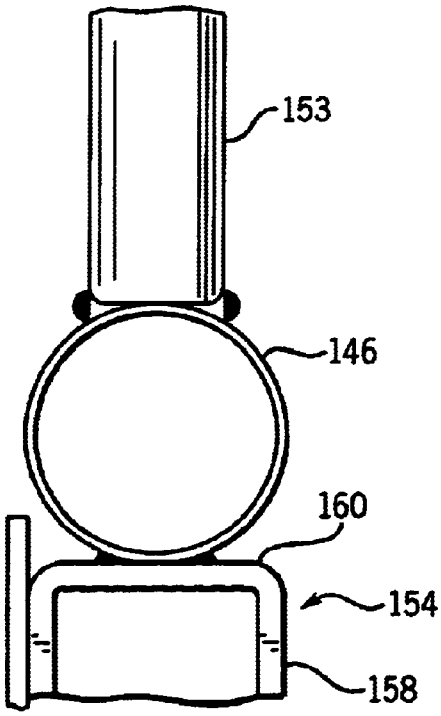
FIG. 15C is an end elevation view of the end portion of the backrest interior structure of FIG. 15B.

Referring to FIG. 14, a swivel axle receiving tube 140 is connected to the interior side of each swing arm 122 at the upper end of upper arm portion 124. Receiving tube 140 receives a swivel axle 144 and includes a first stop opening 142 that receives a stop bar 150. Swivel axle 144 extends through a backrest 145 of backrest assembly 108 and is rotatably contained within an axle housing tube 146 located within backrest 145. Swivel axle 144 also includes a second stop opening 148 that aligns with first stop opening 142 in receiving tube 140 when swivel axle 144 is inserted into receiving tube 140 so that stop bar 150 is inserted through both first stop opening 142 and second stop opening 148. A pair of stop members 152 are welded to the exterior of axle housing tube 146 at each end to limit the rotation of backrest 145 about swivel axle 144 by engaging stop bar 150 when backrest 145 reaches a certain angle of rotation relative to axle housing tube 146, thereby preventing further rotation of backrest 145. Also welded to the exterior of axle housing tube 146 within backrest 145 is a backrest beam 154, best illustrated in FIGS. 15–15A.

Backrest beam 154 is hollow and rectangular in shape and extends to within one inch of the full width of backrest 145. Beam 154 has a front surface 156, a rear surface 158 and pair of parallel side surfaces 160 forming the top and bottom of beam 154. Beam 154 is attached to axle housing tube 146 on one of the side surfaces 160 so that the front surface 156 and rear surface 158 extend perpendicularly to the axis of housing tube 146. A support board 164 is attached to rear surface 158 of beam 154 by a number of screws 166 threadably mounted to beam 154 through support board 164 and rear surface 158, securing board 164 to beam 154. Support board 164 is mounted flush with side surface 160 adjacent axle housing 146 and extends downwardly past beam 154 to a level corresponding with the lower end of backrest 145. A support member 168 is attached at the lower end of support board 164 to provide a mounting surface for Velcro closures (not shown) located on and used to fasten an upholstered cover 171 over backrest 145. A pair of internally threaded tubes 153 are attached to housing tube 146 opposite beam 154 to facilitate the attachment of a pull handle 184 (FIG. 2) to backrest 145.

Figure 13:
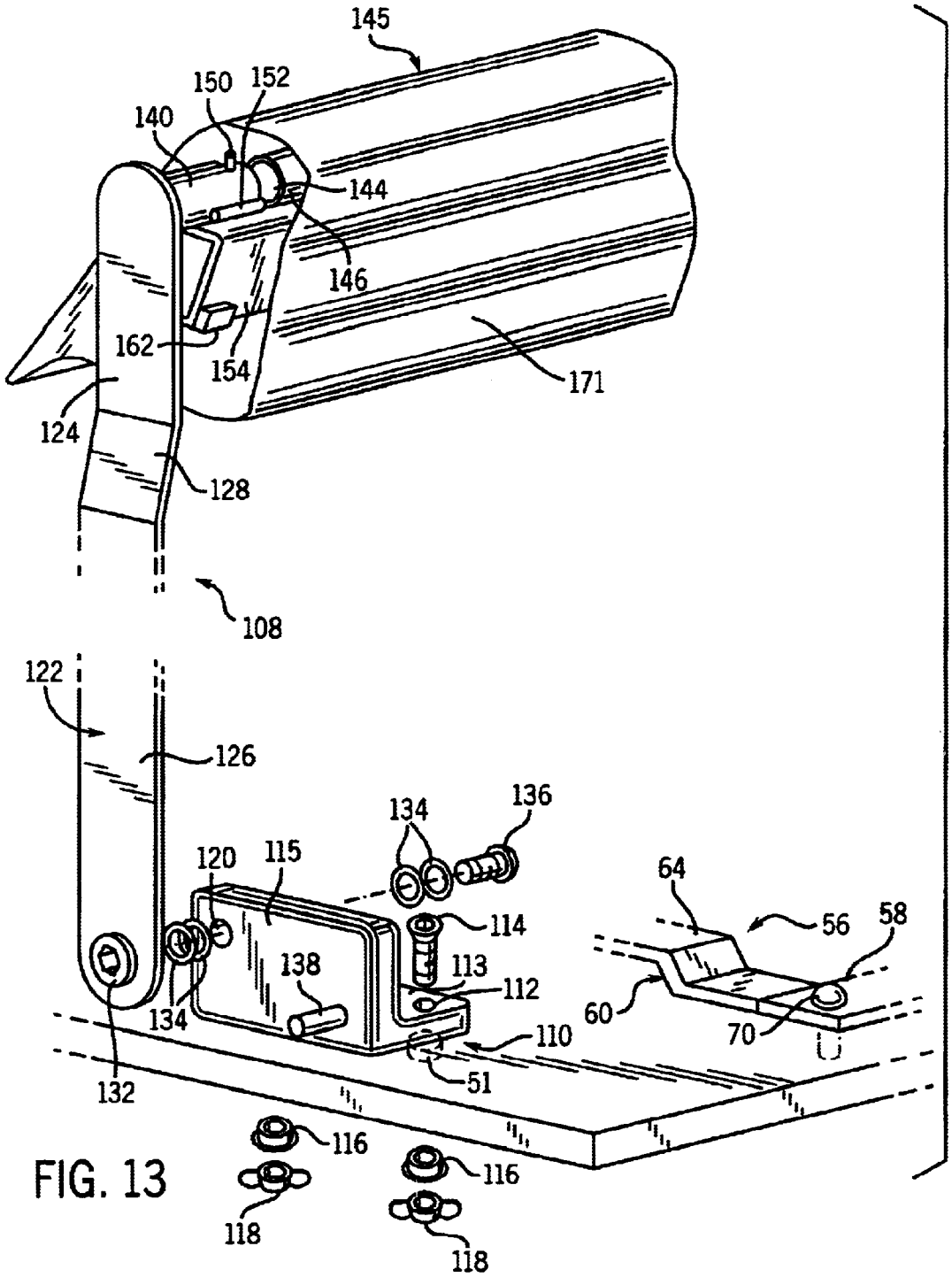
FIG. 13 is a partial exploded isometric view of the swing arm assembly of the daybed of FIG. 1.

As best shown in FIGS. 3 and 13, backrest 145 includes a foam backrest pad 170, which encloses all of the components of the backrest assembly 108, and the upholstered cover 171. The pad 170 has a convex front surface 172, a rounded top surface 174, a flat back surface 176, and a concave bottom surface 178. Back surface 176 extends below the level of front surface 172 and forms a wedge-shaped pad portion 179 that is able to engage either the front or rear rounded edge of cushions 54 to form a continuous padded surface when daybed 10 is in either the seating configuration or the sleeping configuration, as shown by FIG. 3.

In operation, daybed 10 is quickly and easily convertible from its seating configuration of FIG. 1 to its sleeping configuration of FIG. 2. To place daybed 10 in the sleeping configuration, the user grasps a pull handle strap 184 threadably engaged with threaded tubes 153, and pulls backrest assembly 108 forwardly. This causes forward pivoting movement of swing arms 122, and the user continues such movement of backrest 145 and swing arms 122 until swing arms 122 engage stop pins 138. This stops further pivoting movement of swing arms 122, and places backrest assembly 108 in its FIG. 2 position, in which the back surface 176 of backrest 145 is substantially coplanar with the top surfaces of seat cushions 54. Simultaneously, stop members 152 on axle housing tube 146 engage stop bars 150 to prevent rotation of backrest 145 about swivel axle 144. In this manner, the rotational position of swing arms 122 is fixed, as is the rotational position of backrest 145 relative to swing arms 122. Concave bottom surface 178 of backrest 145 conforms to the curvature of the front edge of cushions 54 to provide additional support for backrest 145 when pivoted forwardly. In this position, the flat back surface 176 of backrest 145 is coplanar with the horizontal upper surfaces of cushions 54 to provide a horizontal padded surface satisfactory for sleeping.

Backrest 145 also includes a zipper strip 180 (FIG. 2) and a zipper tab 182 attached to back surface 176 that are engageable with a zipper mating strip 106 attached to the end of bed cover 84 and used to removably secure bed cover 84 over the top of pad 170 and cushions 54 when daybed 10 is in the sleeping configuration of FIG. 2. In this manner, bed cover 84 is engaged with backrest assembly 108 and is rolled off of tube 88 as backrest assembly 108 is pivoted forwardly. That is, bed cover 84 is pulled from behind cushions 54 by shifting backrest assembly 108 from the seating configuration to the sleeping configuration, thereby rotating retractor mechanism 86 and allowing bed cover 84 to extend over cushions 54 when daybed 10 is in the sleeping configuration. When backrest assembly 108 is in its full forward position, bed cover 84 functions to cover the upwardly facing surfaces of seat cushions 54 and backrest 145, acting as a mattress pad and covering the openings between cushions 54 and backrest 145. When backrest assembly 108 is returned to its seating configuration as in FIG. 1, the torsional spring force exerted by rewind spring 94 functions to rewind bed cover 84 onto tube 88.

Periodically, to either wash or replace bed cover 84 as desired, bed cover 84 can be removed from backrest assembly 108 by disengaging zipper strips 106 and 180 from each other, and removing tube 88 in a manner as is known.

Bed cover 84 may be constructed of any type of sheet material. Typically, cushions 54 and backrest 145 will be covered with conventional bedding such as sheets, which may be stored within storage area 19. Alternatively, bed cover 84 may be a dual-layer construction incorporating a zipper or other similar closure, to provide a sleeping bag type construction supported by cushions 54 and backrest 145. This construction eliminates the need for extra bedding and provides a ready-to-use sleeping arrangement when daybed 10 is in its sleeping configuration. In this embodiment, the rolled diameter of the dual-layer material is relatively large, and cannot fit within the cushion channel 82. A rolled material housing is thus provided below deck 32, and the material passes through a gap formed in deck 32.

Figure 16:
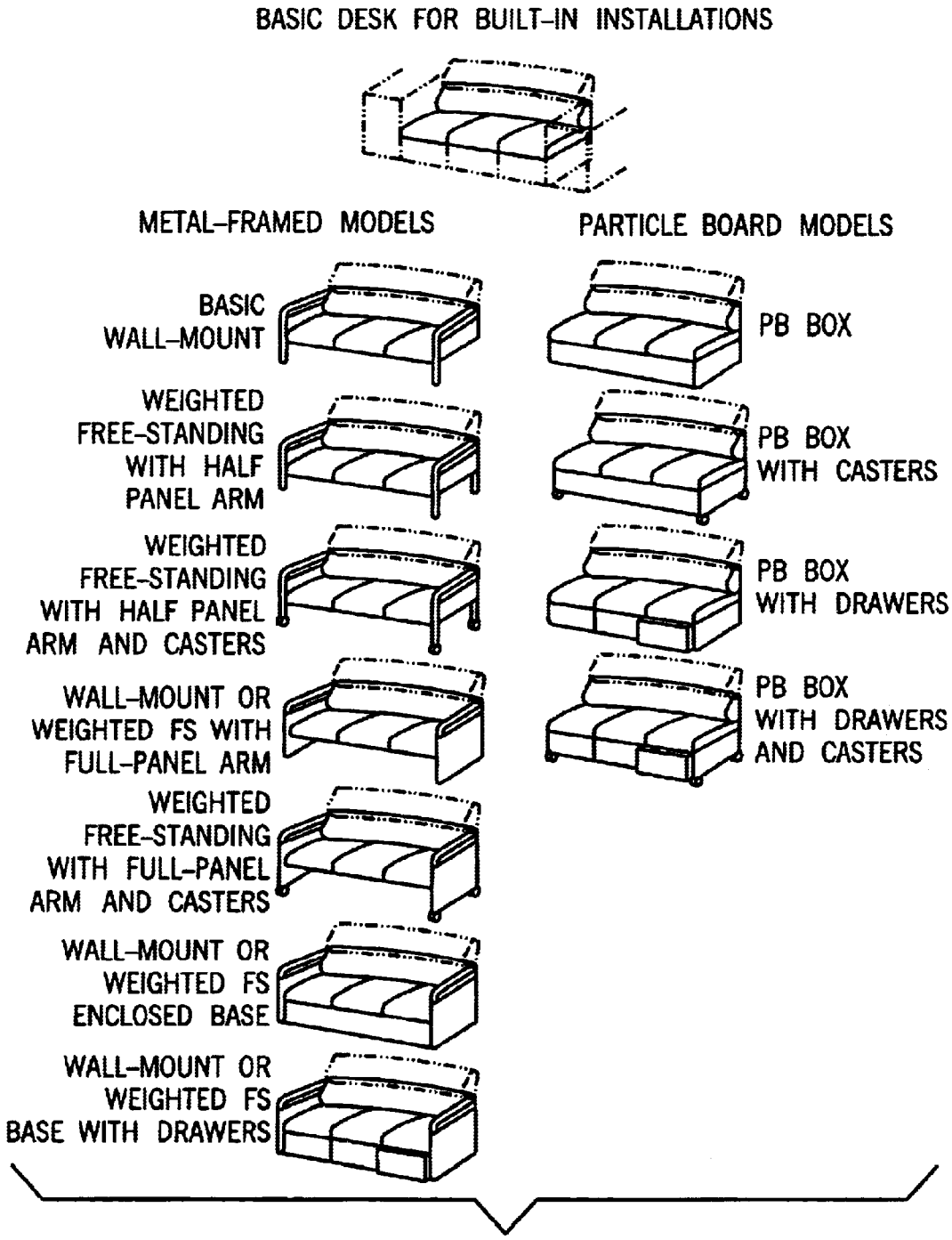
FIG. 16 illustrates various configurations available for the convertible daybed of the present invention.

FIG. 16 illustrates the various available configurations for daybed 10, each of which incorporates pivotable backrest 145 for movement relative to cushions 54 as shown and described.

Backrest 145 has been shown and described as being movable relative to cushion 54 by means of pivotable swing arms 108. It should be understood, however, that any other mechanism may be employed to mount backrest 145 for movement, such as a linkage mechanism or a horizontal slide mechanism providing vertical movement of backrest 145 at the front of cushion 54.

Figure 17:
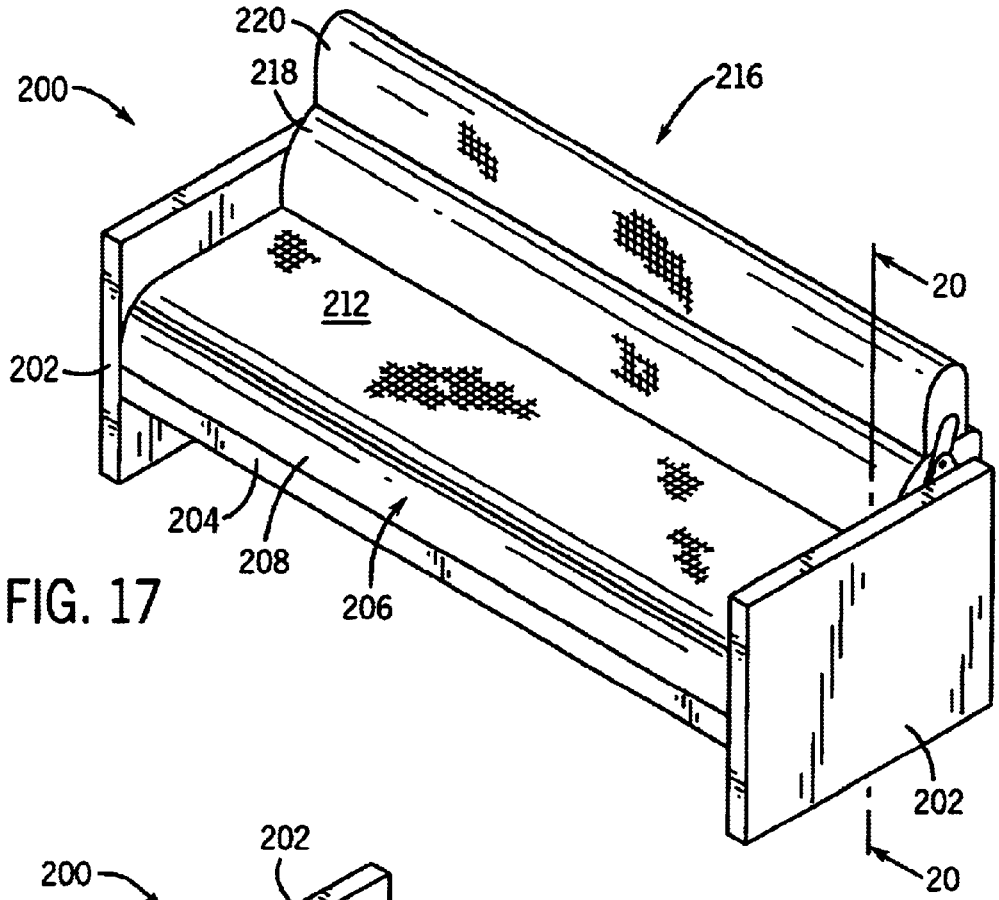
FIG. 17 is an isometric view of another embodiment of the convertible bed of the present invention, which incorporates an articulated sectional backrest assembly, showing the backrest assembly in an upstanding rearward position.
Figure 18:
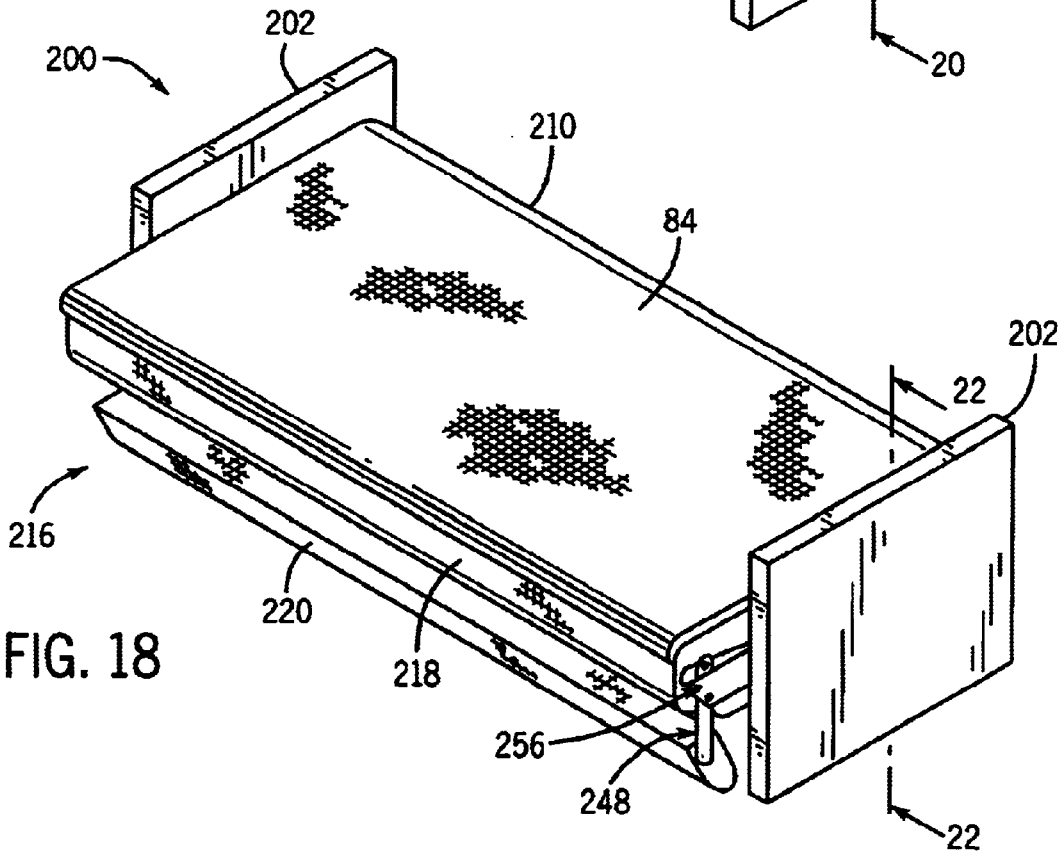
FIG. 18 is a view similar to FIG. 17, showing the backrest assembly in a lowered forward position.
Figure 19:
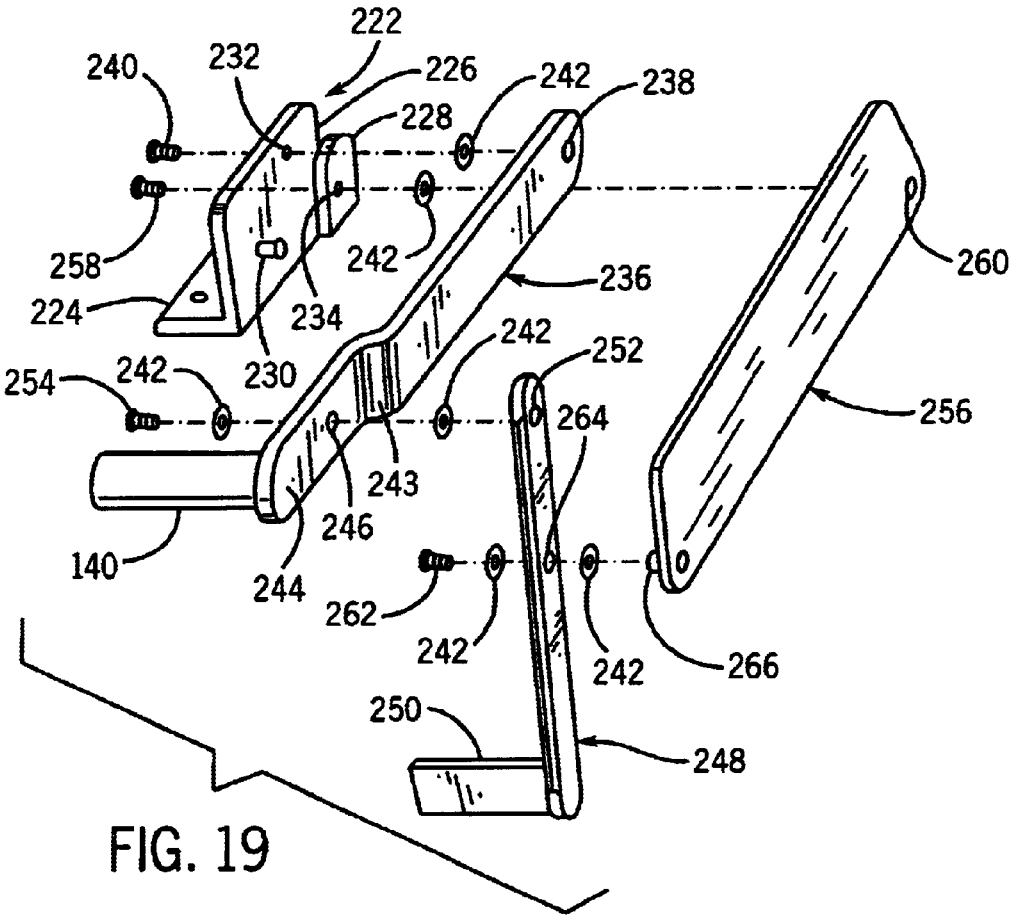
FIG. 19 is an exploded partial isometric view of the components for mounting the sectional backrest assembly in the convertible bed of FIG. 17.

FIGS. 17–22 illustrate an alternative embodiment of a convertible bed, shown at 200. Convertible bed 200 is adapted to be converted from a seating configuration as shown in FIG. 17 to a sleeping configuration as shown in FIG. 18, in a similar manner as described with respect to convertible daybed 10.

Convertible bed 200 includes a pair of end supports 202 and a platform 204 extending therebetween. Platform 204 supports a stationary primary cushion 206 which defines a rounded forward edge 208, a rearward edge 210 and an upwardly facing primary seating or support surface 212 located therebetween.

Convertible bed 200 further includes a sectional articulated backrest assembly 216 having an inner backrest member 218 and an outer extension backrest member 220.

Backrest assembly 216 defines a secondary support member which is movable between an upstanding rearward position as shown in FIG. 17, which places convertible bed 200 in a seating configuration, and a lowered forward position as shown in FIG. 18, which places convertible 200 in a sleeping configuration. When backrest assembly 216 is in the upstanding rearward position as shown in FIG. 17, inner backrest member 218 functions in a manner as described previously with respect to convertible bed 10, to provide lower back support for a user seated upon primary cushion 206. Similarly, when backrest assembly 216 is in the lowered forward position of FIG. 18, inner backrest member 218 functions in the same manner as described with respect to convertible bed 10 to provide a forward extension of seating surface 212, to configure convertible bed 200 as a bed. Also as described previously, bed cover 84 is connected to the rearward surface of inner backrest member 218 and retractor mechanism 86 is located below the lower rearward edge of primary cushion 206, for providing a covering to the sleeping surface of convertible bed 200 when in its sleeping configuration of FIG. 17.

When backrest assembly 216 is in its upstanding rearward position of FIG. 17, outer backrest member 220 extends upwardly from the upper edge of inner backrest member 218 to form an extended back cushion, to provide support for the upper area of a user's back when the user is seated on seating surface 212 of primary cushion 206. When backrest assembly 216 is in its lowered forward position of FIG. 18, outer backrest member 220 is positioned below inner backrest member 218 and inwardly of the outer edge of inner backrest member 218, to place outer backrest member 220 in an unobtrusive position.

FIGS. 19–22 illustrate the components which are located at each end of primary cushion 206 and backrest assembly 216, for providing movement of backrest assembly 216 between its upstanding rearward position of FIG. 17 and its lowered forward position of FIG. 18. The following description pertains to the components located at one end of primary cushion 206 and backrest assembly 216, with the understanding that the description applies equally to mirror image components located at the other end of primary cushion 206 and backrest assembly 216.

A bracket 222 is secured to platform 204 adjacent end support 202, and includes a horizontal section 224 and a vertical section 226. Horizontal section 224 is adapted to be rigidly secured to platform 204 or to any other satisfactory support structure which supports primary cushion 206. A offset mounting tab 228 is secured to vertical section 226 of bracket 222. A stop pin 230 extends outwardly from the outer surface of bracket vertical section 226. In addition, bracket vertical section 226 and mounting tab 228 include respective apertures 232, 234.

An inner swing or pivot arm 236 is pivotably interconnected with bracket 222 at an inner end defined by inner pivot arm 236. The inner end of pivot arm 236 defines an aperture 238 adapted to be placed in alignment with aperture 232 in bracket vertical section 226, and a connector 240 extends through the aligned apertures to define the pivot axis for inner pivot arm 236. A low friction washer 242 is placed between inner pivot arm 236 and bracket vertical section 226, for facilitating movement of inner pivot arm 236.

Inner pivot arm 236 includes an inward bend 243 forming a laterally offset section 244 toward its outer end. A receiving tube 140 extends inwardly from the outer end of pivot arm 236, for mounting backrest inner section 218 to inner pivot arm 236 as described previously. An aperture 246 is formed in outer section 244 of inner pivot arm 236, inwardly of tube 140 and outwardly of bend 243 in pivot arm 236.

An outer pivot arm 248 functions to pivotably interconnect outer backrest member 220 with inner pivot arm 236. Outer pivot arm 248 includes a laterally extending mounting member 250, to which outer backrest member 220 is mounted in a fixed angular position relative to outer pivot arm 248.

The inner end of outer pivot arm 248 includes an aperture 252 which is adapted to be placed into alignment with aperture 246 in offset outer section 244 of inner pivot arm 236. A connector 254 is adapted to extend through aligned apertures 246, 252, and defines a pivot axis about which outer pivot arm 248 is pivotable relative to inner pivot arm 236. A low friction washer 242 is located between outer pivot arm 248 and inner pivot arm 236, for facilitating movement of outer pivot arm 248. With this arrangement, outer backrest member 220 is pivotably supported on inner pivot arms 236 via outer pivot arms 248.

A control member 256 is interconnected between bracket 222 and outer pivot arm 248, for controlling the movement of outer pivot arm 248, and thereby outer backrest member 220, during movement of backrest assembly 216 between its upstanding rearward position and its lowered forward position. Control member 256 defines an inner end which is interconnected with bracket 222 by engagement of a pivot connector 258 through aperture 234 in mounting tab 228, and with an aperture 260 formed in the inner end of control member 256. At its outer end, control member 256 is pivotably secured to outer pivot arm 248 via a pivot connector 262 extending through an a aperture 264 formed in outer pivot arm 248, and into engagement with a receiver 266 secured to the outer end of control member 256. Again, low friction washers 242 are placed on either side of outer pivot arm 248, for facilitating relative movement between outer pivot arm 248 and control member 256.

Inner pivot arm 236, outer pivot arm 248 and control member 256 make up an arm or linkage mechanism, which provides movement of backrest assembly 216 between its upstanding rearward position of FIG. 17 and its lowered forward position of FIG. 18.

In assembly, the inner end of inner pivot arm 236 is located within a space defined between control member 256 and the outer surface of backrest vertical section 226. Mounting tab 228 has a thickness which functions to space control member 256 outwardly an amount sufficient to receive inner pivot arm 236 therebetween. Similarly, bend 243 provides a lateral inward offset for offset section 244 of inner pivot arm, to define a space between offset section 244 and control member 256 within which outer pivot arm 248 is received.

Figure 21:
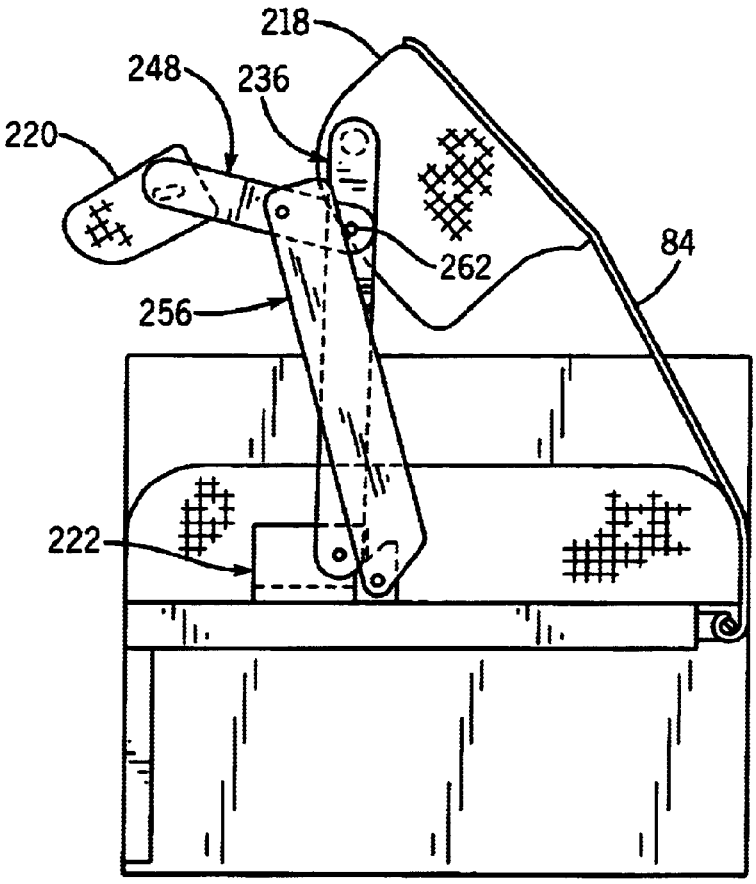
FIG. 21 is a view similar to FIG. 20, showing movement of the sectional backrest assembly away from its upstanding rearward position and toward the lowered forward position of FIG. 22.

In operation, backrest assembly 216 is normally in its upstanding rearward position as shown in FIG. 17. When it is desired to configure convertible bed 200 in a sleeping configuration, the user stands in front of convertible bed 200 and grasps outer backrest member 220. The user then exerts a forward force on outer backrest member 220 so as to pull outer backrest member 220 forwardly. Exertion of this type of force on outer backrest member 220 functions to simultaneously pull both outer backrest member 220 and inner backrest member 218 forwardly, so as to rotate inner pivot arm 236 in a clockwise direction relative to bracket 222, and outer pivot arm 248 in a clockwise direction relative to inner pivot arm 236, with reference to FIG. 21. During such forward movement of backrest assembly 216, control member 256 functions to advance outer backrest member 220 forwardly relative to inner backrest member 218, as shown in FIG. 21, to create a separation between inner and outer backrest members 218, 220, respectively, by pivoting outer pivot arm 248 about the pivot axis defined by connector 262. Inner pivot arm 236 controls movement of inner backrest member 218, and functions to move inner backrest member 218 to its position of FIG. 22, to place convertible bed 200 in a sleeping configuration wherein inner backrest member 218 extends forwardly from forward edge 208 of primary cushion 206. Stop pin 230 engages inner arm 236, so as to prevent further movement of inner arm 236 and thereby to maintain inner backrest member 218 in its forwardly extending position of FIG. 22.

Figure 22:
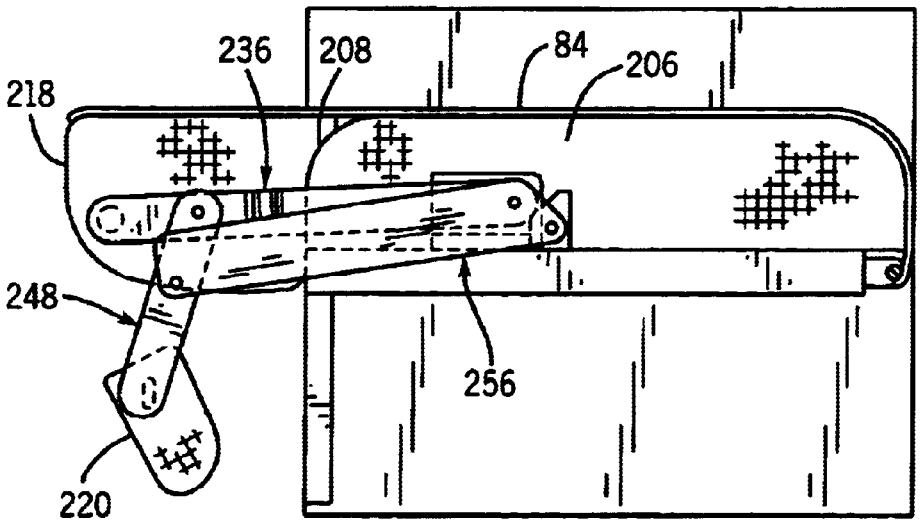
FIG. 22 is a view similar to FIGS. 20 and 21, showing the sectional backrest assembly in a lowered forward position, with reference to line 22—22 of FIG. 18.

When backrest assembly 216 is in its lowered forward position of FIG. 22, outer backrest member 220 is moved downwardly and rearwardly relative to inner backrest member 218, by operation of control member 256. As shown in FIG. 22, outer backrest member 220 is positioned completely below inner backrest member 218 and inwardly of the forwardmost edge of inner backrest member 218. In this manner, outer backrest member 220 is positioned in an out of the way location when convertible bed 200 is in its sleeping configuration.

Figure 20:
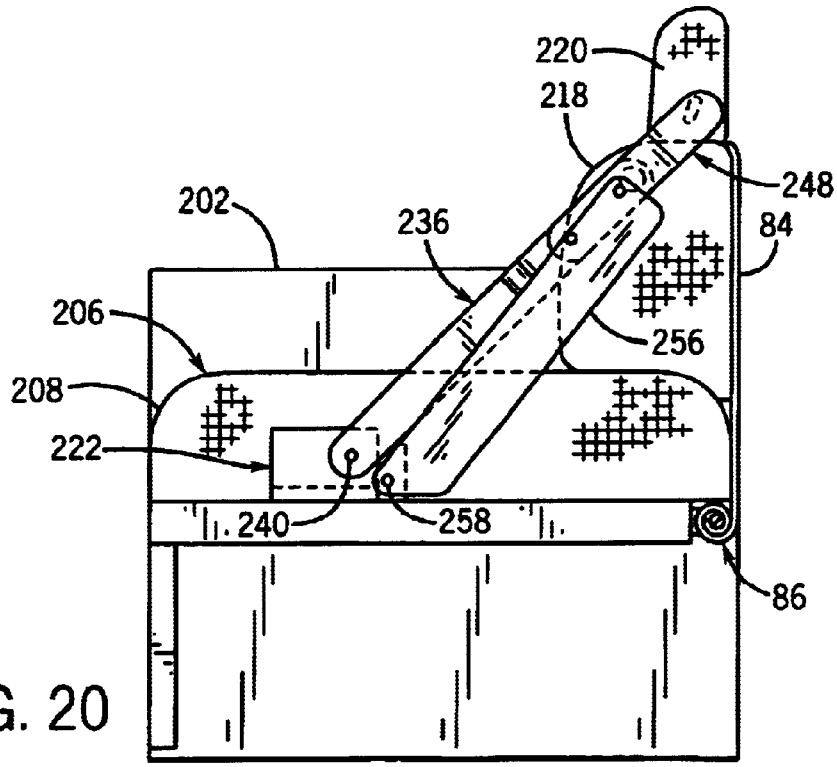
FIG. 20 is a section view taken along line 20—20 of FIG. 17, showing the sectional backrest assembly in its upstanding rearward position.

In order to return convertible bed 200 to its seating configuration, the user normally initiates such movement by grasping the underside of inner backrest member 218 when backrest assembly 216 is in its lowered forward position, and exerting an upward force on inner backrest member 218 so as to lift inner backrest member 218 and rotate inner pivot arm 236 about mounting bracket 222. After inner backrest member 218 is initially lifted in this manner, the user then grasps outer backrest member 220 and continues such rearward pivoting movement of backrest assembly 216, to return backrest assembly 216 to its upstanding rearward position as shown in FIG. 20. Again, control member 256 functions to control movement of outer backrest member 220 as backrest assembly 216 is returned to its upstanding rearward position.

It should be understood that various aspects of backrest assembly 216 may be altered from the specific details as shown and described. For example, while control member 256 is shown and described as being mounted to the same structure as inner pivot arm 236, control member 256 may also be mounted to any other mounting structure separate from mounting bracket 222 or associated with the support structure of convertible bed 200. Further, the angular relationships between outer pivot arm 248, inner pivot arm 236 and control member 256 may vary from the angular relationships as shown and described, to position outer backrest member 220 in any other desired position relative to inner backrest member 218 when backrest assembly 216 is in either its lowered forward position or its upstanding rearward position. For example, outer backrest member 220 is shown and described as being positioned completely below and inwardly of inner backrest member 218 when backrest assembly 216 is in its lowered forward position. It is understood that outer backrest member 220 may be positioned in any inoperative location relative to inner backrest member 218 when backrest assembly 216 is in its lowered forward position, e.g. partially below and/or partially inwardly relative to inner backrest member 218. In addition, while outer pivot arm 248 is described as being located between inner pivot arm 236 and control member 256, it is contemplated that the components may be assembled in any other satisfactory configuration while providing a similar overall function. The configuration as shown and described, however, provides a relatively narrow overall envelope for the assembled components to thereby occupy a relatively small amount of space between the end of primary cushion 206 and the facing surface of end support 202.

Various alternatives and embodiments are contemplated as being within the scope of the following claims particularly pointing out and distinctly claiming the subject matter regarded as the invention.

I claim:

1. A convertible article of furniture, comprising:

a support structure;

a primary cushion member stationarily supported by the support structure, wherein the primary cushion member defines a forward end and a rearward end; and a back member movably mounted to the support structure for movement between an upstanding rearward position and a lowered forward position, wherein the back member includes an inner section and a movable outer section, wherein the inner and outer sections extend upwardly from the primary cushion member toward the rearward end of the primary cushion member when the back member is in its upstanding rearward position, and wherein, when the back member is in its lowered forward position, the inner section of the back member extends forwardly from the forward end of the primary cushion member and the outer section of the back member is located below the inner section.

2. The convertible article of furniture of claim 1, wherein the back member is movably mounted to the support structure by means of a linkage arrangement interconnected between the back member and the support structure, wherein the linkage arrangement is operable to guide movement of the inner and outer sections of the back member as the back member is moved between its upstanding rearward position and its lowered forward position.

3. The convertible article of furniture of claim 2, wherein the linkage arrangement comprises an inner link member pivotably interconnected between the support structure and the inner section of the back member, an outer link member pivotably interconnected between the inner link member and the outer section of the back member, and a control member pivotably interconnected between the support structure and the outer link member, wherein the inner link member provides movement of the inner section of the back member between the rearward and forward ends of the primary cushion member, the outer link member provides movement of the outer section of the back member relative to the inner section of the back member, and wherein the control member functions to guide movement of the outer section relative to the inner section as the back member is moved between its upstanding rearward position and its lowered forward position.

4. The convertible article of furniture of claim 3, wherein the inner link member and the control member are pivotably interconnected with the support structure by means of a common pivot bracket.

5. The convertible article of furniture of claim 3, wherein the inner section of the back member is pivotably mounted to the inner link member at a back pivot location located toward an outer end defined by the inner link member, and wherein the outer link member is pivotably interconnected with the inner link member at an outer link pivot location located inwardly of the back pivot location.

6. The convertible article of furniture of claim 5, wherein the control member defines an inner end pivotably interconnected with the support structure and an outer end pivotably interconnected with the outer link member at a location outwardly of the outer link member pivot location.

7. The convertible article of furniture of claim 6, wherein the outer section of the back member is secured toward an outer end defined by the outer link member in a fixed angular relationship relative to the outer link member.

8. The convertible article of furniture of claim 6, wherein the inner section of the back member defines an outer edge located outwardly of the forward end of the primary cushion member when the back member is in its lowered forward position, and wherein the outer link member and the control member are configured so as to position the outer section of the back member below the inner section of the back member and inwardly of the outer edge defined by the inner section of the back member when the back member is in its lowered forward position.

9. The convertible article of furniture of claim 6, wherein the support structure and the back member are configured so as to position both the inner and outer sections of the back member forwardly of the support structure when the back member is in its lowered forward position.

10. The convertible article of furniture of claim 6, wherein the linkage arrangement is constructed such that the outer link member is pivotably mounted between the inner link member and the control member.

11. The convertible article of furniture of claim 1, wherein the back member is movable between its upstanding rearward position and its lowered forward position by means of a first arm member pivotably interconnected between the support structure and the inner section of the back member, and wherein the outer section of the back member is movable relative to the inner section of the back member by means of a second arm member secured to the outer section of the back member and pivotably interconnected with the first arm member.

12. The convertible article of furniture of claim 11, further comprising a control member pivotably interconnected between the support structure and the second arm member, wherein the control member functions to control movement of the outer section of the back member relative to the inner section of the back member as the back member is moved between its upstanding rearward position and its lowered forward position.

13. A convertible article of furniture, comprising:

a primary support member defining a forward end and rearward end and having an upwardly facing support surface; and a secondary support member movably mounted relative to the primary support member, wherein the secondary support member includes an inner section having oppositely facing first and second support surfaces, and an outer section movably mounted to the inner section;

wherein the secondary support member is movable relative to the primary support member between an upstanding rearward position wherein the first support surface of the secondary support member inner section extends upwardly from the upwardly facing support surface of the primary support member rearwardly of the forward end of the primary support-member, and a lowered forward position wherein the second support surface of the secondary support member inner section extends forwardly from the forward end of the primary support member and forms an extension of the upwardly facing support surface of the primary support member; and wherein the outer section of the secondary support member is movable relative to the inner section of the secondary support member between an operative position when the secondary support member is in its upstanding rearward position, in which the outer section extends upwardly from the inner section, and an inoperative position when the secondary support member is in its lowered forward position, in which the outer section is located below the inner section.

14. The convertible article of furniture of claim 13, wherein the article of furniture includes support structure for stationarily supporting the primary support member, and wherein the secondary support member is movably mounted to the support structure.

15. The convertible article of furniture of claim 14, wherein the secondary support member is movably mounted to the support structure by means of a pivot arm arrangement, for movement between the upstanding rearward position and the lowered forward position.

16. The convertible article of furniture of claim 15, wherein the pivot arm arrangement includes an inner pivot arm pivotably interconnected with the support structure, wherein the inner section of the secondary support member is carried by the inner pivot arm, and an outer pivot arm pivotably interconnected with the inner pivot arm, wherein the outer section of the secondary support member is carried by the outer pivot arm, and further comprising a control member movable with the pivot arm arrangement, wherein the control member and the outer pivot arm are configured to position the outer section of the secondary support member above the inner section of the secondary support member when the secondary support member is in its upstanding rearward position, and below the inner section of the secondary support member when the secondary support member is in its lowered forward position.

17. The convertible article of furniture of claim 16, wherein the control member comprises a control arm pivotably interconnected between the support structure and the outer pivot arm and movable along with the inner pivot arm upon movement of the secondary support member between its lowered forward position and its upstanding rearward position.

18. The convertible article of furniture of claim 17, wherein the control member is pivotably interconnected with the outer pivot arm at a location outwardly of the pivotable interconnection of the outer pivot arm with the inner pivot arm.

19. In a convertible article of furniture having an upwardly facing primary support surface defining a forward end and a rearward end, and a movable back cushion member which is movable between an upstanding rearward position in which the movable back cushion member extends upwardly from the primary support surface toward its rearward end, and a lowered forward position in which the movable back cushion member extends forwardly from the forward end of the primary support surface, the improvement comprising a back extension cushion movably mounted to the movable back cushion member, wherein the back extension cushion is movable between an operative position and an inoperative position in response to movement of the back cushion member between its upstanding rearward position and its lowered forward position, wherein the back extension cushion in its operative position extends upwardly from the movable back cushion member, and in its inoperative position is located below the back cushion member.

20. The improvement of claim 19, wherein the movable back cushion member is interconnected with an inner pivot arm for movement between its upstanding rearward position and its lowered forward position, and wherein the back extension cushion is movably interconnected with the inner pivot arm for movement between its operative and inoperative positions.

21. The improvement of claim 20, wherein the back extension cushion is interconnected with the inner pivot arm via an outer pivot arm which is pivotably interconnected with the inner pivot arm, wherein the back extension cushion is carried by the outer pivot arm.

22. The improvement of claim 21, further comprising a control member interconnected with the outer pivot arm for controlling the position of the back extension cushion relative to the back cushion member upon movement of the back cushion member between its upstanding rearward position and lowered forward position.

23. The improvement of claim 22, wherein the control member comprises a fixed-length member pivotably interconnected with the outer pivot arm.

24. The improvement of claim 23, wherein the inner pivot arm includes an inner end which is pivotably interconnected with a support arrangement defined by the convertible article of furniture, and wherein the control member defines an inner end pivotably interconnected with the support arrangement at a location offset from the pivotable connection of the inner pivot arm to the support arrangement, and an outer end pivotably interconnected with the outer pivot arm.

25. The improvement of claim 24, wherein the control member is pivotably interconnected with the outer pivot arm at a location outwardly of the pivot connection between the outer pivot arm and the inner pivot arm.

* * * * *